US007454025B2

(12) United States Patent
Saiki

(10) Patent No.: US 7,454,025 B2
(45) Date of Patent: Nov. 18, 2008

(54) LOUDSPEAKER WITH INTERNAL NEGATIVE STIFFNESS MECHANISM

(75) Inventor: Shuji Saiki, Uda-gun (JP)

(73) Assignee: Panasonic Corporation, Osaka (JP)

( * ) Notice: Subject to any disclaimer, the term of this patent is extended or adjusted under 35 U.S.C. 154(b) by 593 days.

(21) Appl. No.: 10/861,390

(22) Filed: Jun. 7, 2004

(65) Prior Publication Data

US 2004/0252859 A1 Dec. 16, 2004

(30) Foreign Application Priority Data

Jun. 10, 2003 (JP) ..... 2003-164970

(51) Int. Cl.
*H04R 25/00* (2006.01)
*H04R 1/02* (2006.01)
*H04R 1/20* (2006.01)

(52) U.S. Cl. ..... 381/161; 381/349; 381/352

(58) Field of Classification Search ..... 381/150, 381/160–163, 345, 346, 348, 349, 351–353, 381/386, 398, 412; 181/145, 156, 163
See application file for complete search history.

(56) References Cited

U.S. PATENT DOCUMENTS 2,810,021 A 10/1957 Brownscombe
6,431,309 B1 * 8/2002 Coffin ..... 181/156

FOREIGN PATENT DOCUMENTS

| | | |
|---|---|---|
| GB | 2 297 880 | 8/1996 |
| JP | 63-077297 | 4/1988 |
| JP | 2000-308174 | 11/2000 |
| JP | 2001-157290 | 6/2001 |

OTHER PUBLICATIONS

Partial European Search Report dated Apr. 1, 2008 in the corresponding European patent application.

* cited by examiner

*Primary Examiner*—Brian Ensey
(74) *Attorney, Agent, or Firm*—Wenderoth, Lind & Ponack, L.L.P.

(57) ABSTRACT

In a loudspeaker device of the present invention, an interior space of a cabinet is parted into first and second chambers, a diaphragm on which ring-shaped magnetic boards are fixed is attached to a parting board via an edge portion, and ring-shaped fixed magnets are provided so as to face the magnetic boards, respectively. Vibration of the diaphragm vibrated by sound pressure from a speaker unit is intensified by forces of attraction of the magnets in order to reduce an acoustic stiffness of the cabinet and equivalently increase a cabinet volume, thereby realizing satisfactory bass reproduction with a small cabinet.

20 Claims, 11 Drawing Sheets

LOUDSPEAKER WITH INTERNAL NEGATIVE STIFFNESS MECHANISM

BACKGROUND OF THE INVENTION

1. Field of the Invention

The present invention relates to a loudspeaker device, and more particularly to a loudspeaker device which implements satisfactory bass reproduction using a compact cabinet.

2. Description of the Background Art

As the digitization of audio equipment proceeds, it has become possible to readily reproduce a bass signal contained in a music source using a compact apparatus, e.g., a portable CD player, or a DVD player. However, a loudspeaker device, which performs final sound reproduction, requires a large cabinet volume for bass reproduction, and therefore there is a difficulty in realizing a compact loudspeaker device capable of satisfactory bass reproduction.

Various systems have been proposed for realizing a loudspeaker device capable of satisfactory bass reproduction using a compact cabinet. For example, in a bass-reflex system which is currently the most popular bass reproduction system, an acoustic port is provided to a cabinet in which a speaker unit is provided, and an acoustic resonance determined by an acoustic stiffness, which is caused according to a cabinet volume, and acoustic mass of the acoustic port is used for extending a bass reproduction range. However, even in the bass-reflex system, there is a difficulty in realizing satisfactory bass reproduction unless the acoustic stiffness caused according to the cabinet volume is decreased, i.e., unless the cabinet volume is increased.

For example, Japanese Patent Laid-Open Publication No. 2000-308174 discloses a conventional loudspeaker device having an improved bass reproduction limit which is determined based on a cabinet volume. The conventional loudspeaker device disclosed in Japanese Patent Laid-Open Publication No. 2000-308174 is described below with reference to FIG. 11. FIG. 11 is a cross-sectional structure diagram of the conventional loudspeaker device.

In FIG. 11, the conventional loudspeaker device is generally structured by a speaker cabinet 1 and a speaker unit 2. The speaker unit 2 includes a center pole 3, a magnet 4, a plate 5, a voice coil 6, a voice coil bobbin 7, a frame 8, a damper 9, a cone diaphragm 10, an edge portion 11, a dust cap 12, a movable magnet 13, and a fixed magnet 14. The plate 5 has its surface fixed on an upper face of the magnet 4 (i.e., a surface of the magnet 4 which faces the diaphragm 10). The voice coil 6 wraps around an outer surface of the voice coil bobbin 7, and is situated in a magnetic gap between an outer surface of the center pole 3 and an inner surface of the plate 5. The frame 8 is fixed on an upper face of the plate 5 (i.e., a surface of the plate 5 which faces the diaphragm 10). The damper 9 has its outer edge fixed on the frame 8, and supports the outer surface of the voice coil bobbin 7. The cone diaphragm 10 is fixed around an upper end portion of the voice coil bobbin 7. The edge portion 11 is situated between the frame 8 and the diaphragm 10 so as to support an outer edge of the diaphragm 10. The dust cap 12 is fixed on the diaphragm 10. The movable magnet 13 has a ring-like shape, and its inner surface is fixed on the outer surface of the voice coil bobbin 7. The fixed magnet 14 has a ring-like shape, and its inner surface is opposed to the outer surface of the movable magnet 13 so as to form a gap between the fixed magnet 14 and the movable magnet 13. The fixed magnet 14 is magnetized so as to have the same polarity as that of the movable magnet 13 in a thickness direction.

Described next is an operation of the thus-configured conventional loudspeaker device. When an electric signal is applied to the voice coil 6, a drive force is generated. As in an ordinary loudspeaker, the drive force vibrates the cone diaphragm 10 connected to the voice coil bobbin 7, thereby generating sound. This conventional loudspeaker is considerably different from ordinary loudspeakers due to an interaction between the movable magnet 13 fixed on the outer surface of the voice coil bobbin 7 and the fixed magnet 14 opposed to the movable magnet 13. When the cone diaphragm 10 is vibrated by the drive force generated in the voice coil 6, the movable magnet 13 attached to the voice coil bobbin 7 is also caused to vibrate inside an inner edge of the fixed magnet 14. As described above, the movable magnet 13 and the fixed magnet 14 are magnetized so as to have the same polarity as each other in the thickness direction, and therefore the movable magnet 13 and the fixed magnet 14 repel each other. Accordingly, if the movable magnet 13 deviates from the center of the fixed magnet 14, so that they are no longer magnetically balanced with each other, the movable magnet 13 acts to apply a force away from the center of the fixed magnet 14, i.e., a negative stiffness, to a vibration system of the speaker unit 2. Due to a magnetic force generated in the movable magnet 13, a force functioning as the negative stiffness reduces a bouncing force of an acoustic stiffness of the cabinet 1. As a result, the loudspeaker device having a small cabinet is able to realize satisfactory bass reproduction as if the loudspeaker unit is provided in a larger cabinet.

In the conventional loudspeaker device disclosed in Japanese Patent Laid-Open Publication No. 2000-308174, however, a negative stiffness generation mechanism, i.e., the movable magnet 13 and the fixed magnet 14 are provided in the speaker unit 2, and therefore the structure of the speaker unit 2 is complicated. Moreover, since the movable magnet 13 is attached to the voice coil bobbin 7, the weight of the vibration system is increased, resulting in a reduction of an output sound pressure level of the speaker unit 2.

Further, the negative stiffness is set so as to reduce the acoustic stiffness caused in accordance with the cabinet volume. Accordingly, in the above conventional loudspeaker device, the cabinet 1 is required to be sealed so as not to cause air to leak therefrom, and therefore there is a difficulty in employing a bass-reflex cabinet which is advantageous in extending the reproduction limit to a frequency band lower than that of the reproduction limit for the sealed cabinet.

SUMMARY OF THE INVENTION

Therefore, an object of the present invention is to provide a loudspeaker device capable of satisfactory bass reproduction using a compact cabinet, while maintaining a satisfactory output sound pressure level, without changing a speaker unit structure.

Another object of the present invention is to provide a loudspeaker device capable of satisfactory bass reproduction and having a structure adaptable for use with bass-reflex type bass reproduction means or the like which reproduce bass using acoustic resonance.

The present invention has the following features to attain the object mentioned above.

A first aspect of the present invention is directed to a loudspeaker device which includes: a cabinet; a parting board for parting an interior space of the cabinet into a first chamber and a second chamber; a speaker unit provided in the first chamber of the cabinet so as to face an exterior space; and a negative stiffness generation mechanism applied to the parting board and reducing an acoustic stiffness of the second chamber.

In the first aspect, the negative stiffness generation mechanism for reducing the acoustic stiffness of the second chamber reduces an acoustic stiffness of a cabinet chamber behind the speaker unit, and equivalently increases the cabinet volume, thereby realizing satisfactory bass reproduction by the loudspeaker device having a small cabinet. In the above loudspeaker device, the speaker unit and the negative stiffness generation mechanism are separately provided in the cabinet, and therefore a general-purpose speaker unit can be used for sound reproduction without making any change thereto. Accordingly, satisfactory bass reproduction can be achieved without changing the structure of the speaker unit, while it is possible to prevent a sound pressure level from being lowered due to an increase of the weight of a vibration system of the speaker unit, thereby maintaining a satisfactory output sound pressure level.

The negative stiffness generation mechanism may include: a diaphragm provided at a border between the first and second chambers; at least one suspension for supporting the diaphragm against the parting board; and a repulsive force generation section for generating a repulsive force so as to cause the diaphragm to move away from an equilibrium position in a vibration direction of the diaphragm supported by the at least one suspension. Since the repulsive force generation section applies the repulsive force so as to cause the diaphragm to move away from the equilibrium position, the amplitude of the diaphragm is increased by the repulsive force, thereby reducing the acoustic stiffness of the cabinet.

As described below, it is possible to provide various types of repulsive force generation sections. A first exemplary repulsive force generation section includes: a magnetic substance fixed on at least a portion of the diaphragm; and a plurality of fixed magnets fixed opposite to each other with respect to the magnetic substance so as to form a predetermined gap in front of and behind the magnetic substance in the vibration direction of the diaphragm. In the first exemplary repulsive force generation section, forces of attraction are alternately applied from the plurality of magnets fixed on the magnetic substance of the diaphragm, and therefore the repulsive force is applied to the diaphragm, thereby generating a negative stiffness. The diaphragm and the magnetic substance may be integrally formed. In this case, a magnetic substance, which is separately provided from the diaphragm, is not required to be fixed to the diaphragm during a production process, making it possible to ensure more stable dimensional accuracy and thereby to ensure stable performance.

A second exemplary repulsive force generation section includes: a magnetic substance fixed on at least a portion of the diaphragm; a plurality of plates fixed opposite to each other with respect to the magnetic substance so as to form a predetermined gap in front of and behind the magnetic substance in the vibration direction of the diaphragm, the plurality of plates each having a center pole formed in its center; and a plurality of magnets each fixed to a corresponding one of the plurality of plates and ring-shaped around the plate. A third exemplary repulsive force generation section includes: a magnetic substance fixed on at least a portion of the diaphragm; a plurality of yokes fixed opposite to each other with respect to the magnetic substance so as to form a predetermined gap in front of and behind the magnetic substance in the vibration direction of the diaphragm; and a plurality of magnets each fixed in a center of a corresponding one of the plurality of yokes. In the second and third exemplary repulsive force generation sections, the plates each having a center pole or the yokes are used, and therefore it is possible to concentrate magnetic flux generated in the magnet onto the plates or the yokes. Accordingly, magnetic efficiency is enhanced, making it possible for a smaller magnetic circuit to generate a force of magnetic attraction for generating a required negative stiffness.

A fourth exemplary repulsive force generation section includes: a magnet fixed on at least a portion of the diaphragm; and a plurality of magnetic substances fixed opposite to each other with respect to the magnet so as to form a predetermined gap in front of and behind the magnet in the vibration direction of the diaphragm. In the fourth exemplary repulsive force generation section, forces of attraction are alternately applied from the plurality of magnets fixed on the magnetic substance of the diaphragm, and therefore the repulsive force is applied to the diaphragm, thereby generating a negative stiffness.

A fifth exemplary repulsive force generation section includes: a diaphragm-side magnet fixed on at least a portion of the diaphragm; and a ring-shaped fixed magnet fixed outside an outer edge of the diaphragm-side magnet so as to form a predetermined gap between the ring-shaped fixed magnet and the diaphragm-side magnet. Specifically, the diaphragm-side magnet and the ring-shaped fixed magnet are magnetized so as to have the same magnetization direction in the equilibrium position. Accordingly, when the diaphragm-side magnet is repelled by the ring-shaped fixed magnet, the above-mentioned repulsive force is applied to the diaphragm, thereby generating a negative stiffness. Moreover, the repulsive force generation section may further include ring-shaped magnetic plates fixed on opposite pole faces of the ring-shaped fixed magnet. By providing the ring-shaped magnetic plates on opposite pole faces of the ring-shaped fixed magnet, the operating point of the magnet is caused to rise, thereby increasing the magnetic force.

For example, the diaphragm has a cone shape. The diaphragm having a cone shape has a shape effect, which provides the diaphragm with high rigidity as compared with a planar diaphragm, and therefore the diaphragm can be thinner than the planar diaphragm. That is, the diaphragm can be lighter, thereby further improving bass reproduction efficiency.

Further, the suspension may be an edge portion formed of an airtight material and having an outer edge entirely connected to the parting board and an inner edge entirely supporting an outer edge of the diaphragm, and the second chamber may be kept airtight by the cabinet, the parting board, the edge portion, and the diaphragm. In this case, the cabinet is divided by the parting board, the edge portion, and the diaphragm into two chambers. The two chambers are independently kept airtight, and therefore it is possible to acoustically separate a first chamber formed behind the speaker unit from a second chamber formed behind the negative stiffness generation mechanism. For example, it is possible to structure a loudspeaker device of a bass-reflex type or of a drone cone type which takes advantage of acoustic resonation of the volume behind the speaker unit, making it possible to realize satisfactory bass reproduction using a compact cabinet.

As described below, the above-described suspension may further include various types of elements. In a first example, the suspension may further include: a shaft provided in a center of the diaphragm along the vibration direction of the diaphragm; and a bearing fixed so as to allow the shaft to slide in the vibration direction of the diaphragm. In this case, the shaft and the bearing stabilize the vibration direction of the diaphragm, and therefore the rolling of the diaphragm does not occur. Accordingly, the diaphragm generates more stable vibration.

In a second example, the suspension may further include a plurality of elastic bodies fixed in front of and behind the diaphragm in the vibration direction thereof, so as to have one end connected to the diaphragm, the plurality of elastic bodies expanding and contracting in the vibration direction. In this case, even if the diaphragm is driven by high sound pressure from the speaker unit, and vibrated with high amplitude, the elastic bodies prevent the diaphragm from directly colliding with other elements, thereby preventing the diaphragm from being damaged and preventing the occurrence of collision noise.

In a third example, the suspension may further include at least one damper having an inner edge connected to the diaphragm and a fixed outer edge. In this case, the rolling of the diaphragm is prevented from occurring, and therefore a negative stiffness can be provided more stably.

The loudspeaker device may further include an acoustic resonance section provided in the first chamber of the cabinet so as to resonate with an acoustic stiffness of the first chamber, thereby boosting bass. The acoustic resonance section provides the loudspeaker device with more satisfactory bass reproduction capabilities. Moreover, the loudspeaker device may further include a board-like member fixed to the cabinet so as to form a third chamber in front of the speaker unit, the board-like member having an opening of a predetermined size such that the board-like member functions as a high-cut filter for acoustically cutting off a high frequency range of the speaker unit. The opening of the third chamber and the board-like member acoustically cuts off the high frequency range of the speaker unit. Accordingly, when the loudspeaker device is generally used for bass reproduction, an electric filter is not required for cutting off a high frequency range.

For example, the acoustic resonance section functions as a bass-reflex port which is formed by a hollowed tube and allows the first chamber and an exterior space to be in communication with each other. Since the acoustic resonance section is the bass-reflex port formed by a hollowed tube, the bass reproduction limit can be extended by the acoustic resonance of the bass-reflex port.

Alternatively, the acoustic resonance section is a passive radiator having its rim supported by an edge portion attached to the cabinet. In this case, because the acoustic resonance section is of a drone cone type in the passive radiator supported by an edge portion, the bass reproduction limit can be extended by the acoustic resonance.

In a sixth exemplary repulsive force generation section, the diaphragm has an opening of a predetermined size formed in a center thereof, and the repulsive force generation section includes: a magnetic substance having an opening of the same size as that of the opening of the diaphragm, the magnetic substance being fixed on the diaphragm such that the opening thereof is aligned with the opening of the diaphragm; a first magnetic circuit fixed opposite to the magnetic substance so as to form a predetermined gap on a second chamber side in the vibration direction of the diaphragm; a coupling rod having one end fixed in a center of the first magnetic circuit and passing through the openings of the diaphragm and the magnetic substance so as to form a gap with edges of the openings of the diaphragm and the magnetic substance; and a second magnetic circuit fixed opposite to the magnetic substance and having its center fixed to another end of the coupling rod, the second magnetic circuit forming a predetermined gap with the magnetic substance on a first chamber side in the vibration direction of the diaphragm. The negative stiffness generation mechanism includes a dust cap having its outer edge connected to the diaphragm so as to cover at least the first magnetic circuit and the opening of the diaphragm from the first chamber. Since the second magnetic circuit is directly coupled to the first magnetic circuit via the coupling rod, it is not necessary to use a frame for fixing the second magnetic circuit, for example, thereby considerably simplifying the structure of the negative stiffness generation mechanism.

A second aspect of the present invention is directed to a bass booster provided in a loudspeaker device. The bass booster includes: a cabinet having an opening of a predetermined size; and a negative stiffness generation mechanism fixed to the opening of the cabinet and reducing an acoustic stiffness of a chamber formed by the cabinet.

By providing the bass booster in a conventional loudspeaker device, it is made possible to readily extend the bass reproduction limit of the loudspeaker device. That is, by merely providing the bass booster of the present invention in the user's loudspeaker device, it is possible to boost bass reproduction capabilities of the user's speaker system.

The negative stiffness generation mechanism may include: a diaphragm provided in the opening so as to define a border between the chamber and an exterior space; at least one suspension for supporting the diaphragm against the cabinet; and a repulsive force generation section for generating a repulsive force so as to cause the diaphragm to move away from an equilibrium position in a vibration direction of the diaphragm supported by the at least one suspension. Since the repulsive force generation section applies the repulsive force so as to cause the diaphragm to move away from the equilibrium position, the amplitude of the diaphragm is increased by the repulsive force, thereby reducing the acoustic stiffness of the cabinet.

These and other objects, features, aspects and advantages of the present invention will become more apparent from the following detailed description of the present invention when taken in conjunction with the accompanying drawings.

DESCRIPTION OF THE PREFERRED EMBODIMENTS

Hereinafter, loudspeaker devices of the present invention will be described in detail with reference to the accompanying drawings. The loudspeaker devices of the present invention are able to reduce an acoustic stiffness of a cabinet using a negative stiffness, and are advantageous when used in, for example, a compact loudspeaker system, a loudspeaker system for audio/visual equipment, such as a plasma display panel (PDP), a liquid crystal television, etc., and a vehicle-mounted speaker system.

First Embodiment

Figure 1:
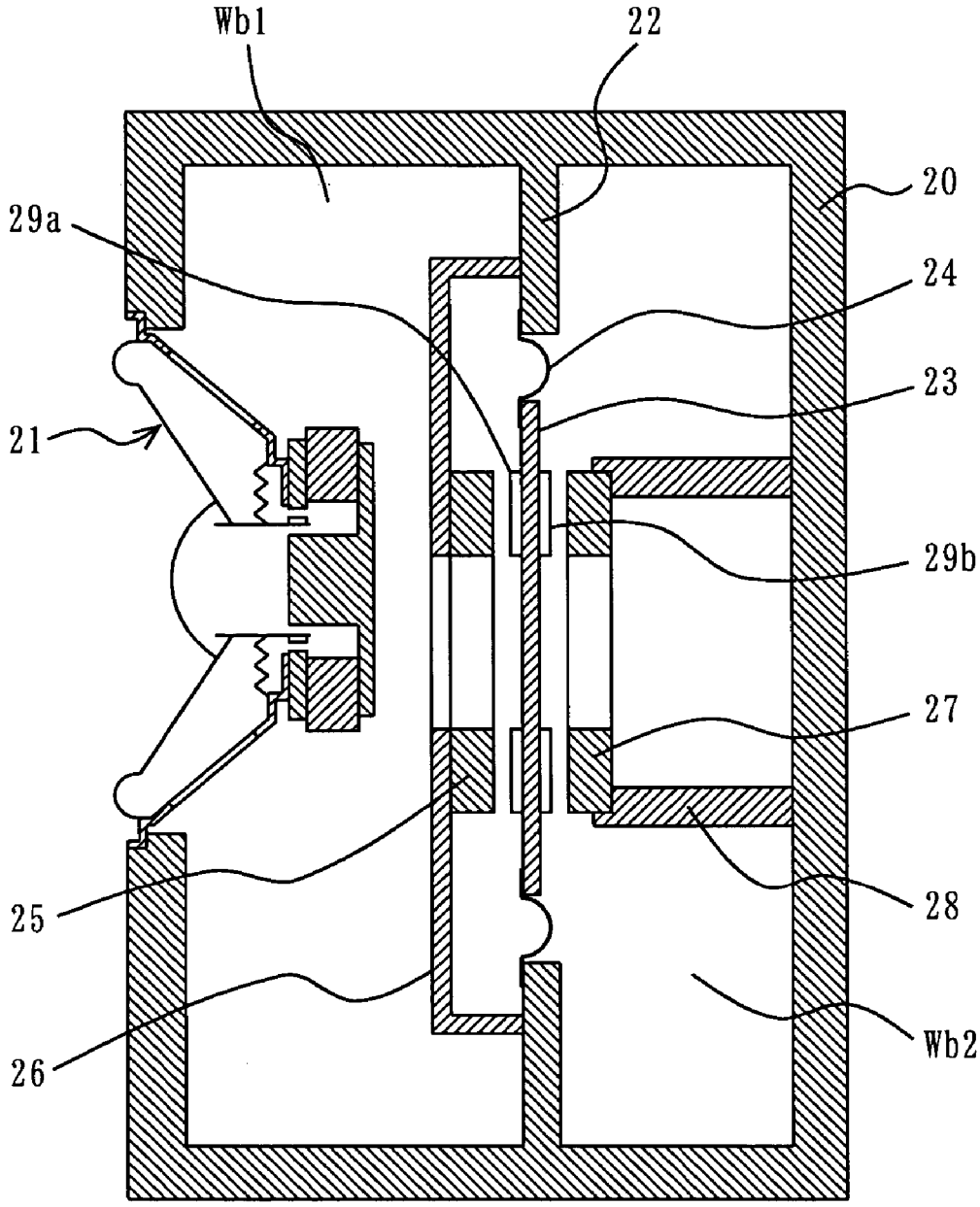
FIG. 1 is a cross-sectional view showing a structure of a loudspeaker device according to a first embodiment of the present invention.

A loudspeaker device according to a first embodiment of the present invention is described with reference to FIG. 1. FIG. 1 is a cross-sectional view showing a structure of the loudspeaker device according to the first embodiment.

In FIG. 1, the loudspeaker device includes a cabinet 20, a speaker unit 21, a parting board 22, a diaphragm 23, an edge portion 24, a first fixed magnet 25, a first supporting member 26, a second fixed magnet 27, a second supporting member 28, a first magnetic board 29*a*, and a second magnetic board 29*b*. Note that in the first embodiment, a negative stiffness generation mechanism is substantially formed by the parting board 22, the diaphragm 23, the edge portion 24, the first fixed magnet 25, the first supporting member 26, the second fixed magnet 27, the second supporting member 28, the first magnetic board 29*a*, and the second magnetic board 29*b*.

The speaker unit 21 has a cone diaphragm, and is attached to an opening of a predetermined size formed in the front of the cabinet 20. The parting board 22 parts an interior space of the cabinet 20 into first and second chambers Wb1 and Wb2. The parting board 22 has a circular opening formed substantially in its center. Note that the speaker unit 21 is situated in the first chamber Wb1. The diaphragm 23 is made of a non-magnetic material, such as plastic, and situated in the circular opening of the parting board 22. The edge portion 24 is a suspension for supporting an outer edge of the diaphragm 23 against the parting board 22. The edge portion 24 is made of an elastomer material, metal foil, or the like, which does not cause air to leak therefrom. The entire outer circumference of the edge portion 24 is connected to an edge of the opening of the parting board 22, and the entire inner circumference of the edge portion 24 supports the outer edge of the diaphragm 23. Accordingly, the parting board 22, the diaphragm 23, and the edge portion 24 form the border between the first and second chambers Wb1 and Wb2, so as to keep the second chamber Wb2 airtight.

The first fixed magnet 25 is a ring-like magnet which is fixed on the parting board 22 via the first supporting member 26 and magnetized in a thickness direction thereof. The first fixed magnet 25 is situated in the first chamber Wb1, such that one surface thereof faces the diaphragm 23. The first supporting member 26 is connected to a surface of the first fixed magnet 25 opposite to the surface facing the diaphragm 23. The first supporting member 26 is fixed on the parting board 22, thereby supporting the first fixed magnet 25. The first supporting member 26 has an opening substantially in its center so as to be aligned with a ring opening of the first fixed magnet 25. The second fixed magnet 27 is a ring-like magnet which is fixed against the back of the cabinet 20 via the second supporting member 28 and magnetized in a thickness direction thereof. The second fixed magnet 27 is situated in the second chamber Wb2, such that one surface thereof faces the diaphragm 23. The second supporting member 28 is connected to a portion of a surface of the second fixed magnet 27 opposite to the surface facing the diaphragm 23. The second supporting member 28 is fixed on the back of the cabinet 20, thereby supporting the second fixed magnet 27.

The first and second magnetic boards 29*a* and 29*b* are ring-shaped magnetic substances, such as iron, permalloy, or the like. The first magnetic board 29*a* is fixed on a surface of the diaphragm 23 which faces the first chamber Wb1, so that the first magnetic board 29*a* faces the first fixed magnet 25 with a predetermined gap formed therebetween. On the other hand, the second magnetic board 29*b* is fixed on a surface of the diaphragm 23 which faces the second chamber Wb2, so that the second magnetic board 29*b* faces the second fixed magnet 27 with a predetermined gap formed therebetween.

Described next is an operation of the loudspeaker device according to the first embodiment. When an electric signal, such as a music signal, is applied to the speaker unit 21, a drive force is generated in a voice coil to vibrate the cone diaphragm, thereby generating sound. The speaker unit 21 is, for example, a dynamic loudspeaker which operates in a well-known manner, and detailed descriptions thereof are omitted here.

Sound pressure generated by the cone diaphragm of the speaker unit 21 is transmitted into the first chamber Wb1 formed by the front of the cabinet 20, the parting board 22, the diaphragm 23, the edge portion 24, and the back of the speaker unit 21. The sound pressure transmitted into the first chamber Wb1 vibrates the diaphragm 23 supported by the parting board 22 via the edge portion 24.

The first and second magnetic boards 29*a* and 29*b* are fixed on opposite surfaces of the diaphragm 23, and vibrated in a vibration direction together with the diaphragm 23. The first magnetic board 29*a* is opposed to the first fixed magnet 25 so as to form a predetermined gap therebetween. The first magnetic board 29*a* is exposed to a force of attraction from the first fixed magnet 25. The second magnetic board 29*b* is opposed to the second fixed magnet 27 so as to form a predetermined gap therebetween. The second magnetic board 29*b* is exposed to a force of attraction from the second fixed magnet 27. Note that the gap between the first magnetic board 29*a* and the first fixed magnet 25 is equivalent in size to the gap between the second magnetic board 29*b* and the second fixed magnet 27, and the forces of attraction from the first and second fixed magnets 25 and 27 are canceled by each other at a reference position (hereinafter, referred to as an "equilibrium position"). The forces of attraction from the first and second fixed magnets 25 and 27 cause a repulsive force from the equilibrium position to be applied to each of the first and second magnetic boards 29*a* and 29*b*.

The repulsive force described above is applied in such a direction as to reduce bouncing force for suppressing the amplitude of the diaphragm 23. Specifically, the repulsive force acts as a negative stiffness for reducing the acoustic stiffness of the second chamber Wb2 which is formed by the rear of the cabinet 20, the parting board 22, the diaphragm 23, and the edge portion 24. The repulsive force facilitates easy vibration of the diaphragm 23 which is acoustically indirectly vibrated by the sound pressure from the speaker unit 21. This alleviates bouncing force caused by acoustic stiffness of chambers of the cabinet 20, so that the cone diaphragm of the speaker unit 21 operates as if the cabinet volume of the loudspeaker device is increased.

As described above, in the loudspeaker device according to the first embodiment, a repulsive force generation mechanism for generating a negative stiffness reduces an acoustic stiffness of a cabinet chamber in the back of the speaker unit, so as to virtually increase the cabinet volume by the amount equivalent to the reduced acoustic stiffness, thereby realizing satisfactory bass reproduction using a compact cabinet. Further, in the loudspeaker device according to the first embodiment, the speaker unit and the repulsive force generation mechanism are separately provided in the cabinet, whereby it is possible to realize satisfactory bass reproduction, while maintaining a satisfactory output sound pressure level, without changing the structure of the speaker unit.

Furthermore, in the first embodiment, a non-magnetic substance is used for the diaphragm 23 in order to achieve an effect of minimizing the weight of the vibration system of the diaphragm 23 itself. However, if there is no need to achieve such an effect, a magnetic substance may be used for the diaphragm 23. In the case of using the magnetic substance, it is not necessary to fix the first and second magnetic boards 29*a* and 29*b* on the diaphragm 23. In this case, the forces of attraction from the first and second magnets 25 and 27 are directly applied to the diaphragm 23 such that the diaphragm 23 is vibrated in a manner similar to the case where the first and second magnetic boards 29*a* and 29*b* are fixed on the diaphragm 23.

Note that even if the first and second magnetic boards 29*a* and 29*b* are fixed and the first and second magnets 25 and 27 are movable, it is possible to achieve an effect similar to that achieved in the above-described case where the first and second magnetic boards 29*a* and 29*b* are movable and the first and second magnets 25 and 27 are fixed. This is because a force of magnetic attraction is generated between the fixed magnetic substances and the movable magnets.

Note that even if the speaker unit is of a piezoelectric type, of an electrostatic type, or of another type, it is possible to achieve an effect similar to that achieved in the above-described case where the speaker unit is of a dynamic type. This is because a negative stiffness is generated and, as a result, the acoustic stiffness of the cabinet chamber raises the bass reproduction limit.

Second Embodiment

Figure 2:
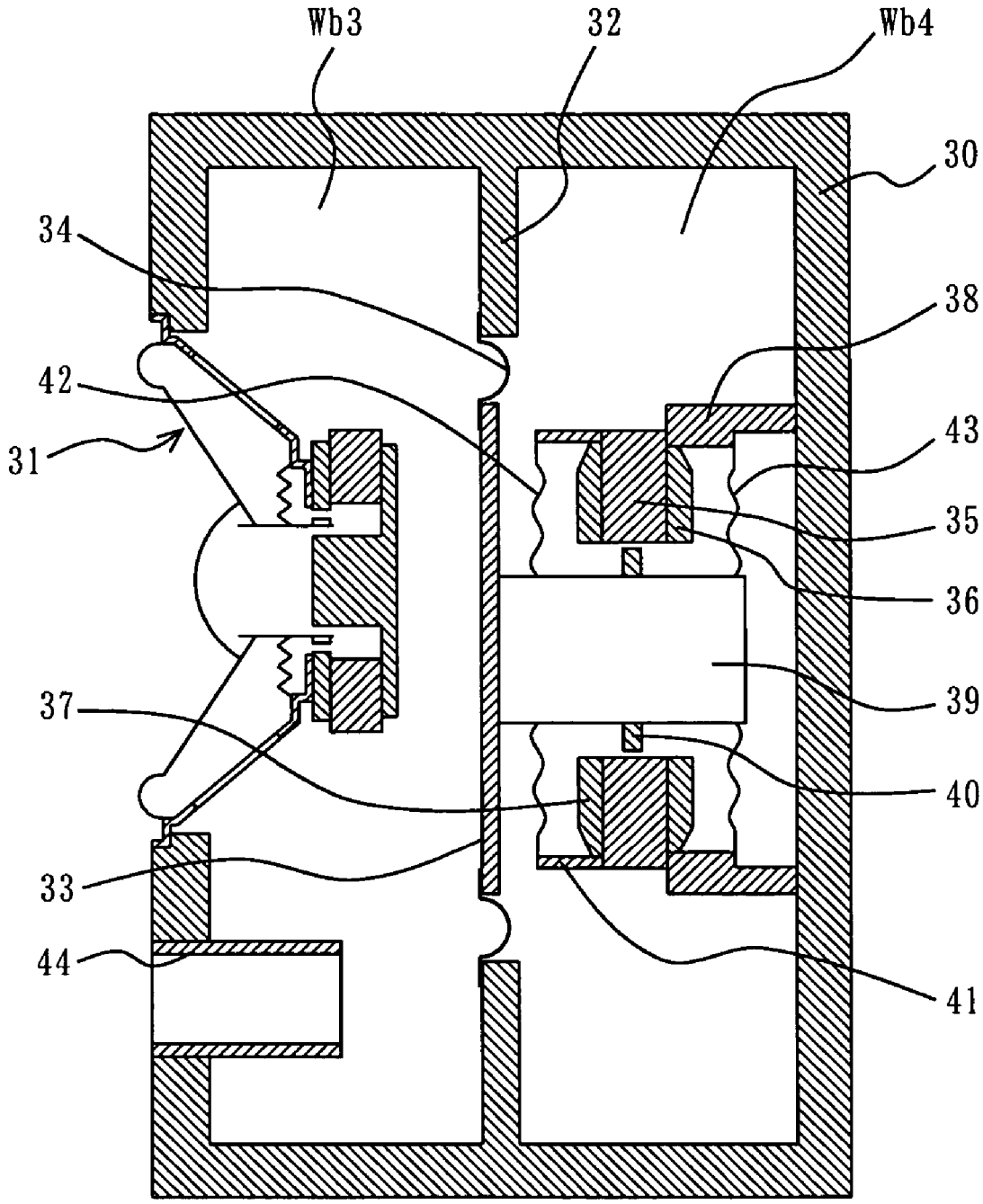
FIG. 2 is a cross-sectional view showing a structure of a loudspeaker device according to a second embodiment of the present invention.

A loudspeaker device according to a second embodiment of the present invention is described with reference to FIG. 2. FIG. 2 is a cross-sectional view showing a structure of the loudspeaker device according to the second embodiment.

In FIG. 2, the loudspeaker device includes a cabinet 30, a speaker unit 31, a parting board 32, a diaphragm 33, an edge portion 34, a fixed magnet 35, plates 36 and 37, a supporting member 38, a bobbin 39, a movable magnet 40, a damper supporting member 41, a first damper 42, a second damper 43, and a bass-reflex port 44. Note that in the second embodiment, a negative stiffness generation mechanism is substantially formed by the parting board 32, the diaphragm 33, the edge portion 34, the fixed magnet 35, the plates 36 and 37, the supporting member 38, the bobbin 39, the movable magnet 40, the damper supporting member 41, the first damper 42, and the second damper 43.

The speaker unit 31 has a cone diaphragm, and is attached to an opening of a predetermined size formed in the front of the cabinet 30. The parting board 32 parts an interior space of the cabinet 30 into first and second chambers Wb3 and Wb4, and has a circular opening formed substantially in its center. Note that the speaker unit 31 is situated in the first chamber Wb3. The diaphragm 33 is made of a non-magnetic material, such as plastic, and is situated in the circular opening of the parting board 32. The edge portion 34 is a suspension for supporting an outer edge of the diaphragm 33 against the parting board 32. The edge portion 34 is made of an elastomer material, metal foil, or the like, which does not cause air to leak therefrom. The entire outer circumference of the edge portion 34 is connected to an edge of the opening of the parting board 32, and the entire inner circumference of the edge portion 34 supports the outer edge of the diaphragm 33. Accordingly, the parting board 32, the diaphragm 33, and the edge portion 34 form the border between the first and second chambers Wb3 and Wb4, so as to keep the second chamber Wb4 airtight.

The fixed magnet 35 is a ring-like magnet which is magnetized in a thickness direction thereof. The fixed magnet 35 have the plates 36 and 37 mounted on its opposite surfaces. The fixed magnet 35 is fixed on the back of the cabinet 30 via the supporting member 38 which supports a portion of one surface of the fixed magnet 35 within the second chamber Wb4. Similar to the fixed magnet 35, the plates 36 and 37 are ring-shaped magnetic substances, and are fixed on the opposite surfaces of the fixed magnet 35 such that openings of the plates 36 and 37 are aligned with each other. The supporting member 38 is fixed on the back of the cabinet 30, so as to support the fixed magnet 35 and the plates 36 and 37 which are assembled as a unit. The damper supporting member 41 having a cylindrical shape is fixed to an outer circumferential portion on a surface of the magnet 35 which faces the diaphragm 33.

The bobbin 39 having a cylindrical shape is provided in the center of a surface of the diaphragm 33 which faces the second chamber Wb4. The movable magnet 40 is a ring-like magnet which is magnetized in its thickness direction. An inner edge of the movable magnet 40 is fixed around the side surface of the bobbin 39. Specifically, the diaphragm 33, the bobbin 39 and the movable magnet 40 are assembled as a unit. The bobbin 39 and the movable magnet 40 are provided so as to pass through an opening of the unit consisting of the fixed magnet 35 and the plates 36 and 37, so that the inner surface of the fixed magnet 35 is opposed to an outer edge of the movable magnet 40 so as to form a predetermined gap therebetween. In this case, the movable magnet 40 has the same magnetized direction as that of the fixed magnet 35. The bobbin 39 is supported by the first and second dampers 42 and 43 fixed around the side surface thereof. The first damper 42 is fixed on the inner surface of the damper supporting member 41, so as to support the bobbin 39 in the vicinity of the diaphragm 33. The second damper 43 is fixed on the inner surface of the supporting member 38, so as to support the bobbin 39 at its end portion. Accordingly, the unit consisting of the diaphragm 33, the bobbin 39, and the movable magnet 40 is stably supported in the vibration direction of the diaphragm 33 by the edge portion 34, the first damper 42 and the second damper 43.

The bass-reflex port 44 is a hollowed acoustic tube attached to the cabinet 30. The bass-reflex port 44 is provided in such a position as to allow the first chamber Wb3 and an exterior space to be in communication with each other. For example, the bass-reflex port 44 is provided in the front of the cabinet 30.

Described next is an operation of the loudspeaker device according to the second embodiment. When an electric signal, such as a music signal, is applied to the speaker unit 31, a drive force is generated in a voice coil to vibrate the cone diaphragm, thereby generating sound. The speaker unit 31 is, for example, a dynamic loudspeaker which operates in a well-known manner, and detailed descriptions thereof are omitted here.

Sound pressure generated by the cone diaphragm of the speaker unit 31 is transmitted into the first chamber Wb3 formed by the front of the cabinet 30, the parting board 32, the diaphragm 33, the edge portion 34, and the back of the speaker unit 31. The sound pressure transmitted into the first chamber Wb3 vibrates the diaphragm 33 supported by the parting board 32 via the edge portion 34.

The bobbin 39 and the movable magnet 40 stably supported in the vibration direction by the first and second dampers 42 and 43 are fixed on a surface of the diaphragm 33 which faces the second chamber Wb4, and the movable magnet 40 is vibrated in the same vibration direction together with the diaphragm 33. The fixed magnet 35 is situated so as to be opposed to the outer edge of the movable magnet 40 and so as to form a predetermined gap between the fixed magnet 35 and the movable magnet 40. The movable magnet 40 and the fixed magnet 35 are magnetized in the same direction. Accordingly, the fixed magnet 35 repels the movable magnet 40. Note that the movable magnet 40 is in a neutral state at a position corresponding to the center of the fixed magnet 35 (hereinafter, referred to as an "equilibrium position"). When the movable magnet 40 is repelled by the fixed magnet 35, a repulsive force is applied to the movable magnet 40 in such a direction as to amplify vibration of the diaphragm 33, i.e., the movable magnet 40 is repulsed away from the equilibrium position.

The repulsive force described above is exerted in such a direction as to reduce bouncing force for suppressing the amplitude of the diaphragm 33. Specifically, the repulsive force acts as a negative stiffness for reducing the acoustic stiffness of the second chamber Wb4 which is formed by the rear of the cabinet 30, the parting board 32, the diaphragm 33, and the edge portion 34. The repulsive force facilitates easy vibration of the diaphragm 33 which is acoustically indirectly vibrated by the sound pressure from the speaker unit 31. This alleviates bouncing force caused by acoustic stiffness of chambers of the cabinet 20, so that the cone diaphragm of the speaker unit 21 operates as if the cabinet volume of the loudspeaker device is increased.

In the second embodiment, the bass-reflex port 44 is provided in the cabinet 30. The bass-reflex port 44 acoustically resonates with an acoustic stiffness caused in accordance with the volume of the cabinet 30, thereby allowing the loudspeaker device according to the second embodiment to function as a bass-reflex type loudspeaker device. As described above, the second chamber Wb4 has its volume virtually increased due to a negative stiffness. Specifically, the bass-reflex port 44 acoustically resonates with the acoustic stiffness of a volume larger than the actual volume of the cabinet 30, i.e., volumes of the first and second chambers Wb3 and Wb4. Accordingly, the loudspeaker device according to the second embodiment operates in the same manner as a bass-reflex loudspeaker having a large cabinet with the speaker unit 31, and therefore is able to provide lower frequency reproduction. Note that in order to efficiently achieve an effect as described above, it is preferred that the first chamber Wb3 is smaller in volume than the second chamber Wb4.

As described above, the loudspeaker device according to the second embodiment has a structure adaptable for use with bass-reflex type bass reproduction means or the like which reproduce bass using acoustic resonance, while achieving an effect similar to that achieved by the loudspeaker device according to the first embodiment.

Although the bass reproduction means described in the second embodiment is of a bass-reflex type, the bass reproduction means may be of another type. For example, in bass reproduction means of a drone cone type in which a diaphragm (a passive radiator) having its rim supported by a suspension (an edge portion) is attached to a cabinet, the diaphragm of a drone cone resonates with an acoustic stiffness of the cabinet, thereby achieving a bass boosting effect similar to that achieved by the bass-reflex type bass reproduction means.

In the second embodiment, a repulsive force generation mechanism has been described as generating a negative stiffness using a magnetic force acting between a movable magnet and a fixed magnet, thereby obtaining a bass boosting effect of a bass-reflex type loudspeaker. It goes without saying that the repulsive force generation mechanism described in the first embodiment as generating a negative force is also able to achieve an effect of a loudspeaker of a bass-reflex type or of a drone cone type.

Third Embodiment

Figure 3:
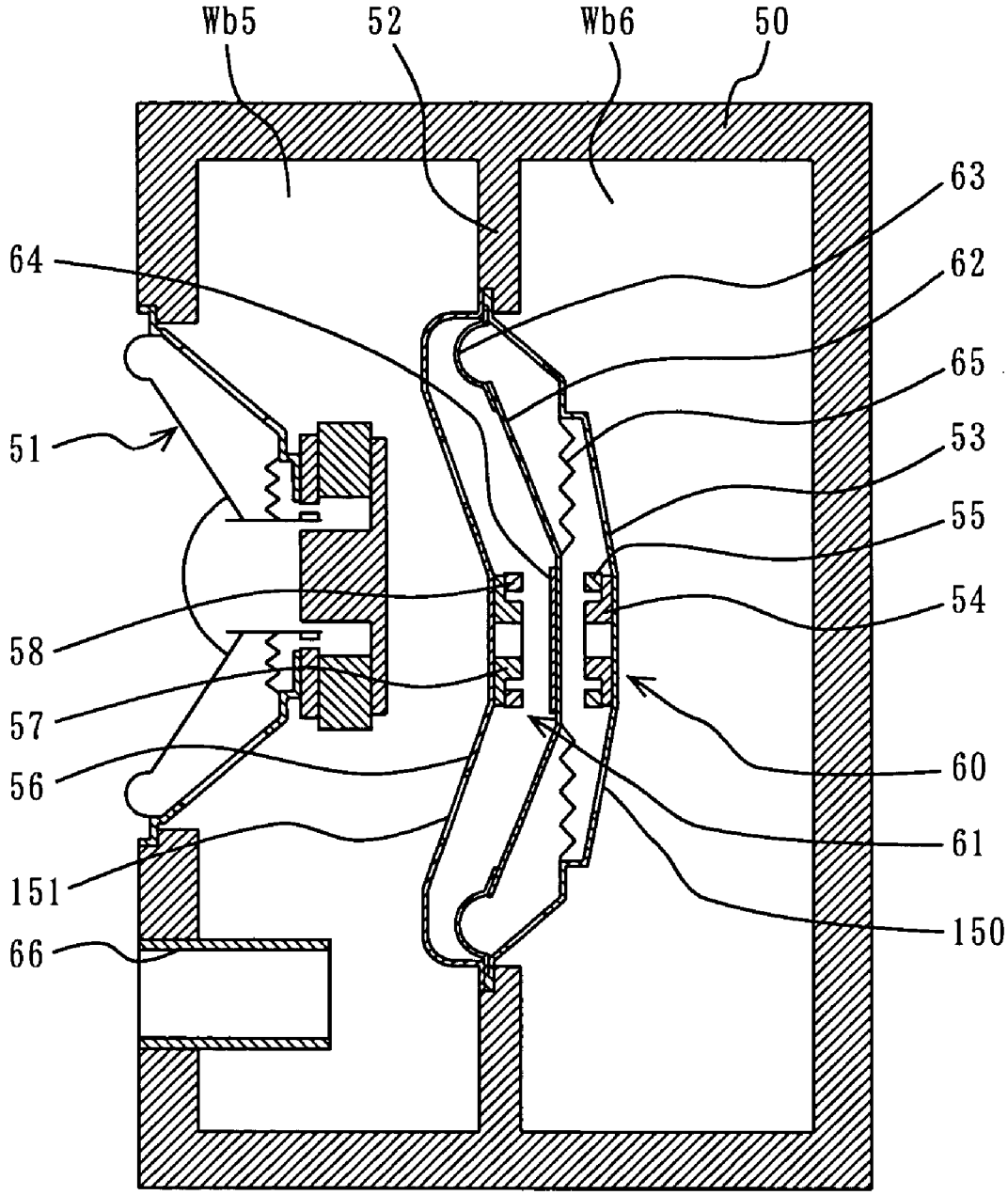
FIG. 3 is a cross-sectional view showing a structure of a loudspeaker device according to a third embodiment of the present invention.

A loudspeaker device according to a third embodiment of the present invention is described with reference to FIG. 3. FIG. 3 is a cross-sectional view showing a structure of the loudspeaker device according to the third embodiment.

In FIG. 3, the loudspeaker device includes a cabinet 50, a speaker unit 51, a parting board 52, a first frame 53, a second frame 56, a first magnetic circuit 60, a second magnetic circuit 61, a diaphragm 62, an edge portion 63, a magnetic board 64, a damper 65, and a bass-reflex port 66. Note that in the third embodiment, a negative stiffness generation mechanism is substantially formed by the parting board 52, the first frame 53, the second frame 56, the first magnetic circuit 60, the second magnetic circuit 61, the diaphragm 62, the edge portion 63, the magnetic board 64, and the damper 65.

The speaker unit 51 has a cone diaphragm, and is attached to an opening of a predetermined size formed in the front of the cabinet 50. The parting board 52 parts an interior space of the cabinet 50 into first and second chambers Wb5 and Wb6, and has a circular opening formed substantially in its center. Note that the speaker unit 51 is situated in the first chamber Wb5.

The first frame 53 is a circular board which has its outer edge fixed on the edge of the opening of the parting board 52 and is convex on the side of the second chamber Wb6. The first frame 53 has a plurality of sound holes 150 formed therein. The second frame 56 is a circular board which has its outer edge fixed on the edge of the opening of the parting board 52 and is concave on the side of the first chamber Wb5. The second frame 56 has a plurality of sound holes 151 formed therein. As shown in FIG. 3, the first and second frames 53 and 56 are fixed on the edge of the opening of the parting board 52, such that a space, which is convex on the side of the second chamber Wb6, is formed between the first and second frames 53 and 56.

The diaphragm 62 is made of a non-magnetic material, and has a cone-like shape. The diaphragm 62 is situated in the space formed between the first and second frames 53 and 56. The edge portion 63 is a suspension for supporting an outer edge of the diaphragm 62 in the vicinity of outer edges of the first and second frames 53 and 56. The edge portion 34 is made of an elastomer material, metal foil, or the like, which does not allow air to leak therefrom. The entire outer circumference of the edge portion 63 is connected in the vicinity of the outer edges of the first and second frames 53 and 56, and the entire inner circumference of the edge portion 63 supports the outer edge of the diaphragm 62. Accordingly, the parting board 52, the outer edges of the first and second frames 53 and 56, the diaphragm 62, and the edge portion 63 form the border between the first and second chambers Wb5 and Wb6, so as to keep the second chamber Wb6 airtight. The diaphragm 62 has a planar portion in its center, and the magnetic board 64, which is a magnetic substance made of iron, permalloy, or the like, is engaged with the planar portion of the diaphragm 62. The planar portion of the diaphragm 62 is supported by the damper 65 in the second chamber Wb6. The damper 65 is a suspension which is connected to the planar portion of the diaphragm 62 and has its entire outer edge fixed to the second frame 56, thereby supporting the diaphragm 62.

The first magnetic circuit 60 includes a plate 54 and a magnet 55. The plate 54 is fixed in the center of the first frame 53 so as to face the diaphragm 62. The plate 54 has a center pole in its center. The magnet 55 has a ring-like shape and is fixed on the plate 54. The second magnetic circuit 61 includes a plate 57 and a magnet 58. The plate 57 is fixed in the center of the second frame 56 so as to face the diaphragm 62. The plate 57 has a center pole in its center. The magnet 58 has a ring-like shape and is fixed on the plate 57. The diaphragm 62 is situated between the first and second magnetic circuits 60 and 61. The first magnetic circuit 60 (i.e., the plate 54 and the magnet 55) and the second magnetic circuit 61 (i.e., the plate 57 and the magnet 58) are opposed to each other with respect to the magnetic board 64 of the diaphragm 62, so as to form a predetermined gap between the magnetic board 64 and each of the first and second magnetic circuits 60 and 61.

The first magnetic circuit 60 includes a plate 54 and a magnet 55. The plate 54 is fixed in the center of the first frame 53 so as to face the diaphragm 62. The plate 54 has a center pole in its center. The magnet 55 has a ring-like shape and is fixed on the plate 54. The second magnetic circuit 61 includes a plate 57 and a magnet 58. The plate 57 is fixed in the center of the second frame 56 so as to face the diaphragm 62. The plate 57 has a center pole in its center. The magnet 58 has a ring-like shape and is fixed on the plate 57. The diaphragm 62 is situated between first and second magnetic circuits 60 and 61. The first magnetic circuit 60 (i.e., the plate 54 and the magnet 55) and the second magnetic circuit 61 (i.e., the plate 57 and the magnet 58) are opposed to each other with respect to the magnetic board 64 of the diaphragm 62, so as to form a predetermined gap between the magnetic board 64 and each of the first and the second magnetic circuits 60 and 61.

The bass-reflex port 66 is a hollowed acoustic tube attached to the cabinet 50. The bass-reflex port 66 is provided in such a position as to allow the first chamber Wb5 and an exterior space to be in communication with each other. For example, the bass-reflex port 66 is provided in the front of the cabinet 50.

Described next is an operation of the loudspeaker device according to the third embodiment. When an electric signal, such as a music signal, is applied to the speaker unit 51, a drive force is generated in a voice coil to vibrate the cone diaphragm, thereby generating sound. The speaker unit 51 is, for example, a dynamic loudspeaker which operates in a well-known manner, and detailed descriptions thereof are omitted here.

Sound pressure generated by the cone diaphragm of the speaker unit 51 is transmitted into the first chamber Wb5 formed by the front of the cabinet 50, the parting board 52, the diaphragm 62, the edge portion 63, and the back of the speaker unit 51. The sound pressure transmitted into the first chamber Wb5 is further transmitted through the plurality of sound holes 151 formed in the second frame 56 to the diaphragm 62 supported against the first and second frames 53 and 56 via the edge portion 63, thereby vibrating the diaphragm 62.

The magnetic board 64 is connected in the center of the diaphragm 64 which is supported by the damper 65, and is vibrated in the same vibration direction together with the diaphragm 62. The diaphragm 62 is situated between the first and second magnetic circuits 60 and 61 so as to form the predetermined gaps with the first and second magnetic circuits 60 and 61, and therefore the magnetic board 64 is stably vibrated between the first and second magnetic circuits 60 and 61. Specifically, the magnetic board 64 alternately experiences forces of attraction from the first and second magnetic circuits 60 and 61 in the vibration direction of the diaphragm 62 in accordance with the vibration of the diaphragm 62. Note that the magnetic board 64 is in a neutral state at a midpoint between the first and second magnetic circuits 60 and 61 (hereinafter, referred to as an "equilibrium position"). When the magnetic board 64 alternately experiences forces of attraction from the first and second magnetic circuits 60 and 61, a repulsive force is applied to the magnetic board 64 in such a direction as to amplify vibration of the diaphragm 62, i.e., the magnetic board 64 is repulsed away from the equilibrium position.

The repulsive force described above is exerted in such a direction as to reduce bouncing force for suppressing the amplitude of the diaphragm 62. Specifically, the repulsive force acts as a negative stiffness for reducing the acoustic stiffness of the second chamber Wb6 which is formed by the rear of the cabinet 50, the parting board 52, the diaphragm 62, and the edge portion 63. The repulsive force facilitates easy vibration of the diaphragm 62 which is acoustically indirectly vibrated by the sound pressure from the speaker unit 51. This alleviates bouncing force caused by acoustic stiffness of chambers of the cabinet 50, so that the cone diaphragm of the speaker unit 51 operates as if the cabinet volume of the loudspeaker device is increased.

In the third embodiment, the bass-reflex port 66 is provided in the cabinet 50. The bass-reflex port 66 acoustically resonates with an acoustic stiffness caused in accordance with the volume of the cabinet 50, thereby allowing the loudspeaker device according to the third embodiment to function as a bass-reflex type loudspeaker device. As described above, the second chamber Wb6 has its volume virtually increased due to a negative stiffness. Specifically, the bass-reflex port 66 acoustically resonates with the acoustic stiffness of a volume larger than the actual volume of the cabinet 50, i.e., volumes of the first and second chambers Wb5 and Wb6. Accordingly, the loudspeaker device according to the third embodiment operates in the same manner as a bass-reflex loudspeaker having a large cabinet with the speaker unit 51, and therefore is able to provide lower frequency reproduction.

Further, the loudspeaker device according to the third embodiment includes the first and second magnetic circuits 60 and 61 which are opposed to each other with respect to the magnetic board 64 fixed on the cone diaphragm 62 so as to form a predetermined gap between the magnetic board 64 and each of the first and second magnetic circuits 60 and 61. Specifically, the diaphragm 62 having a cone-like shape has a shape effect, which provides the diaphragm 62 with high rigidity as compared with the planar diaphragms described in the first and second embodiments, and therefore the diaphragm 62 can be thinner than the planar diaphragms. That is, the diaphragm 62 can be lighter, thereby further improving bass reproduction efficiency. Moreover, since the first and second magnetic circuits 60 and 61 include the plates 54 and 57 which are magnetic substances, magnetic flux generated in the magnet 55 can be concentrated onto the plate 54 and magnetic flux generated in the magnet 58 can be concentrated onto the plate 57. Accordingly, magnetic efficiency is enhanced, making it possible for a smaller magnetic circuit to generate a force of magnetic attraction for generating a required negative stiffness.

As described above, in addition to effects similar to those achieved by the loudspeaker devices according to the first and second embodiments, the loudspeaker device according to the third embodiment is able to achieve an effect of improving a bass reproduction efficiency due to the light weighted diaphragm 62 and an effect of making it possible for a smaller circuit to generate a force of magnetic attraction for generating a required negative stiffness.

Figure 4:
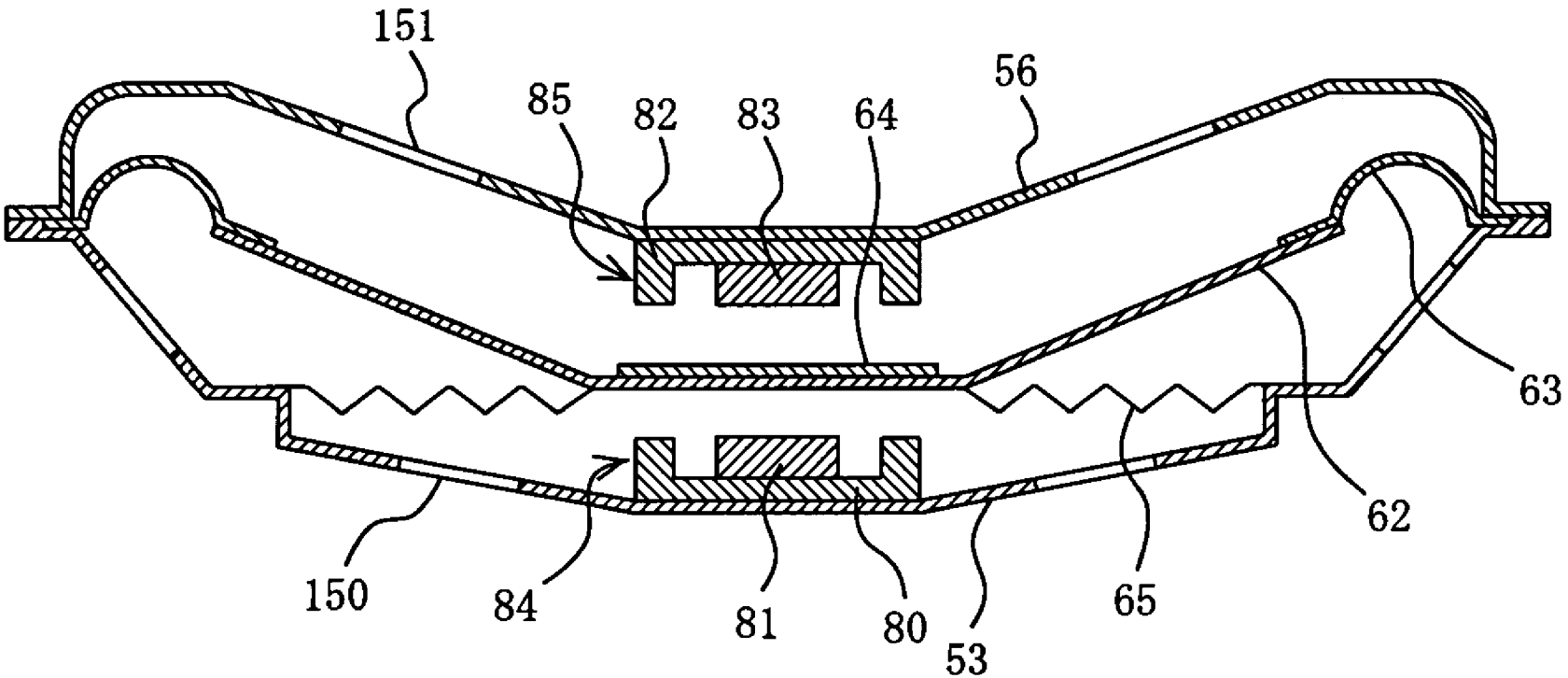
FIG. 4 is a cross-sectional view showing a structure of a first variation of the loudspeaker device shown in FIG. 3.

The first and second magnetic circuits 60 and 61 included in the negative stiffness generation mechanism have been described with reference to FIG. 3 as having an outer magnet configuration in which the magnet 55 is placed on an outer portion of the plate 54 and the magnet 58 is placed on an outer portion of the plate 57. However, the first and second magnetic circuits 60 and 61 can have an inner magnet configuration. For example, as shown in FIG. 4, a first magnetic circuit 84 has an inner magnet configuration in which a magnet 81 is placed in the center of a yoke 80, and a second magnetic circuit 85 has an inner magnet configuration in which a magnet 83 is placed in the center of a yoke 82. In the case of the inner magnet configuration, substantially no magnetic flux of the magnets 81 and 83 leaks out from the magnetic circuits, and therefore magnet use efficiency is further enhanced, making it possible to reduce the size of the first and second magnetic circuits 60 and 61.

Figure 5:
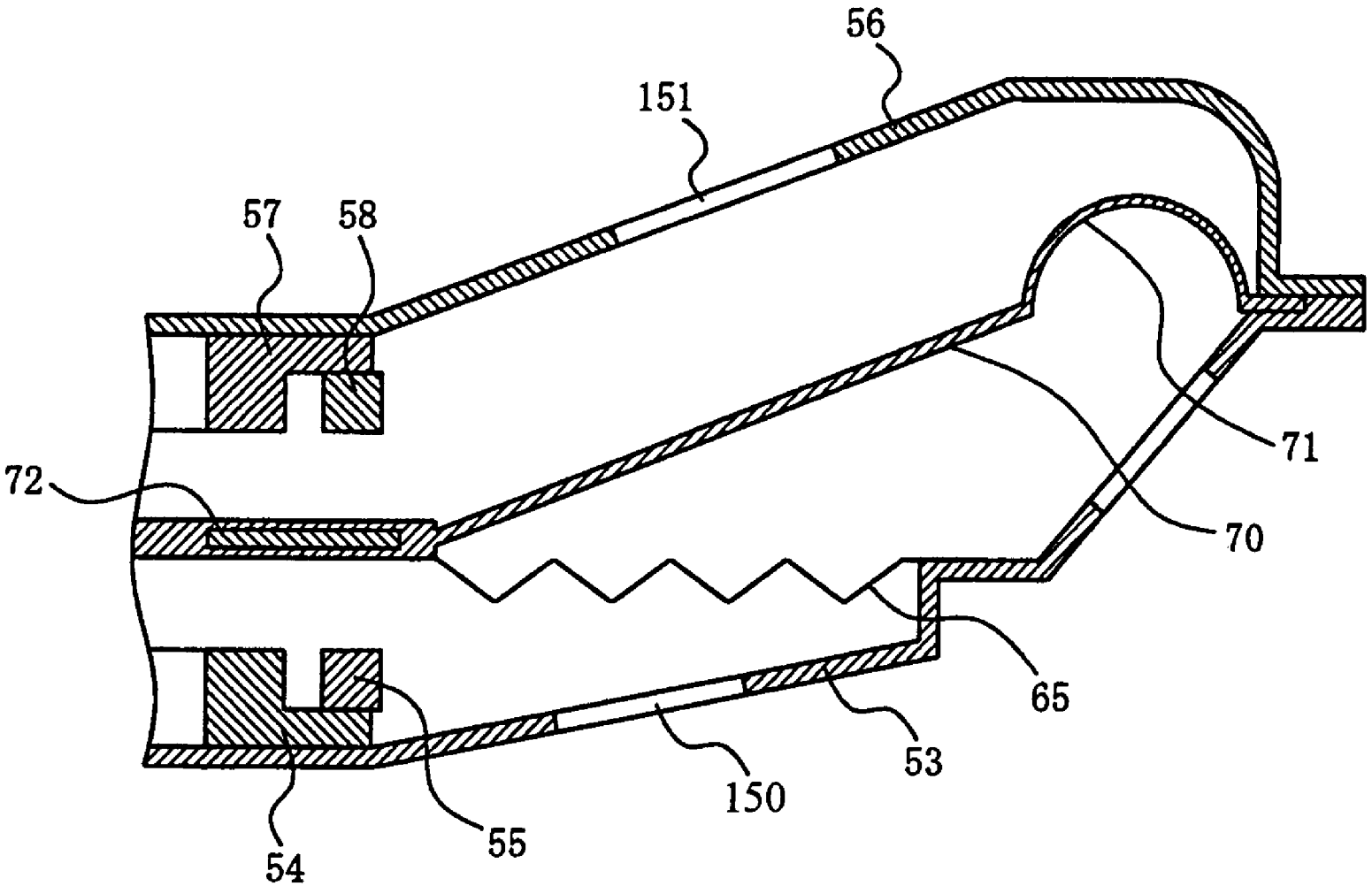
FIG. 5 is a cross-sectional view showing a structure of a second variation of the loudspeaker device shown in FIG. 3.

Further, the diaphragm 62, the edge portion 63, and the magnetic board 64, which are included in the negative stiffness generation mechanism, have been described with reference to FIG. 3 as being separate elements. However, the diaphragm 62, the edge portion 63, and the magnetic board 64 can be integrally formed. For example, as shown in FIG. 5, a diaphragm 70 can be structured so as to have its thinner outer edge portion as an edge portion 71 integrally formed with the diaphragm 70, and so as to have a ring-shaped magnetic board 72 integrally formed inside the center of the diaphragm 70. In this case, it is not necessary to fix an edge portion and a magnetic substance, which are provided as separate elements, to the diaphragm 70 during a production process, making it possible to ensure more stable dimensional accuracy and thereby to ensure stable performance.

Figure 6:
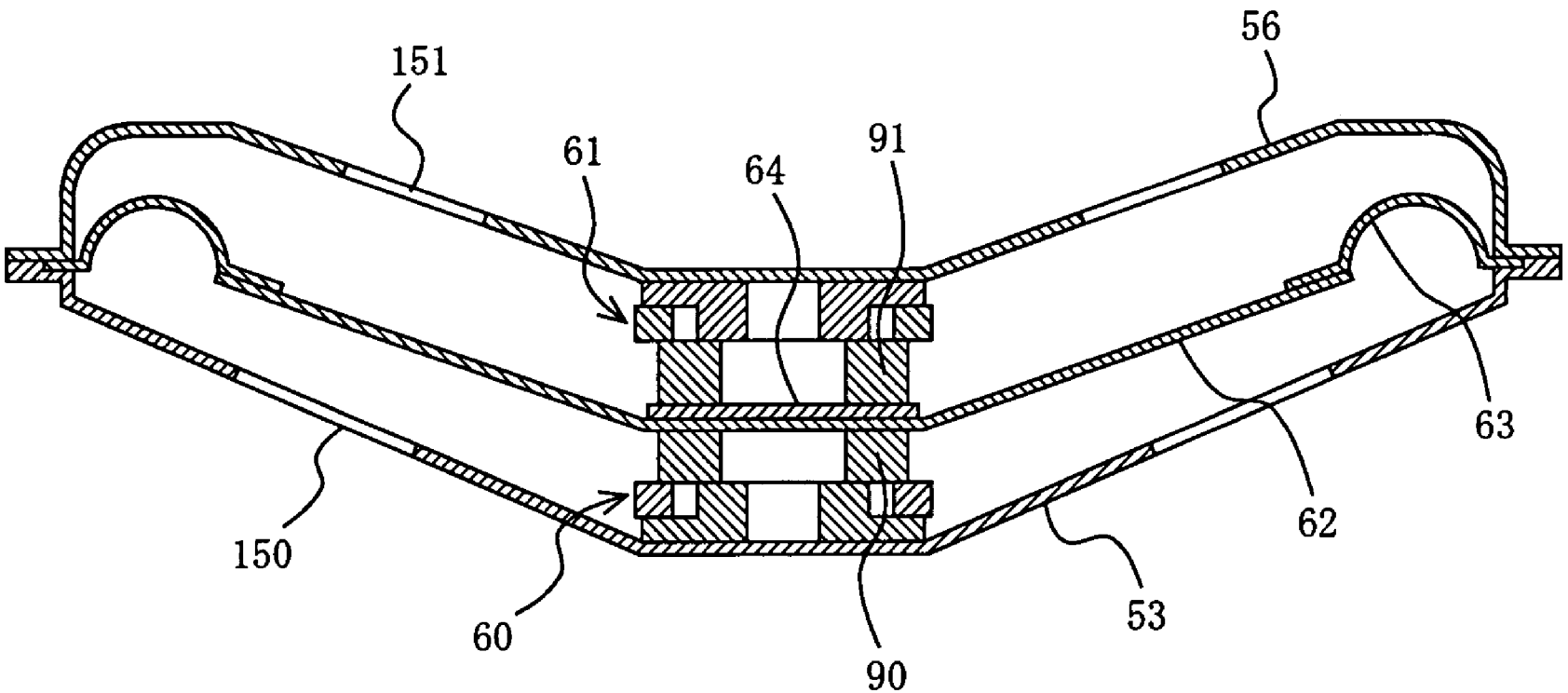
FIG. 6 is a cross-sectional view showing a structure of a third variation of the loudspeaker device shown in FIG. 3.

Furthermore, the diaphragm 62 included in the negative stiffness generation mechanism has been described with reference to FIG. 3 as having its center supported by the damper 65 such that the diaphragm 62 is stably vibrated between the first and second magnetic circuits 60 and 61. However, the diaphragm 62 can be stably vibrated even if the negative stiffness generation mechanism is differently configured. FIG. 6 shows a first example in which the diaphragm 62 is supported by sandwiching an elastic body 90 between the diaphragm 62 and the first magnetic circuit 60, and by sandwiching an elastic body 91 between the diaphragm 62 and the second magnetic circuit 61. For example, the elastic bodies 90 and 91 are springs made of foamed rubber or metal. In this case, even if the diaphragm 62 is driven by high sound pressure from the speaker unit 51, and vibrated with high amplitude, the sandwiched elastic bodies 90 and 91 prevent the diaphragm 62 and the magnetic board 64 from directly colliding with the first and second magnetic circuits 60 and 61, thereby preventing the diaphragm 62 from being damaged and preventing the occurrence of collision noise.

Figure 7:
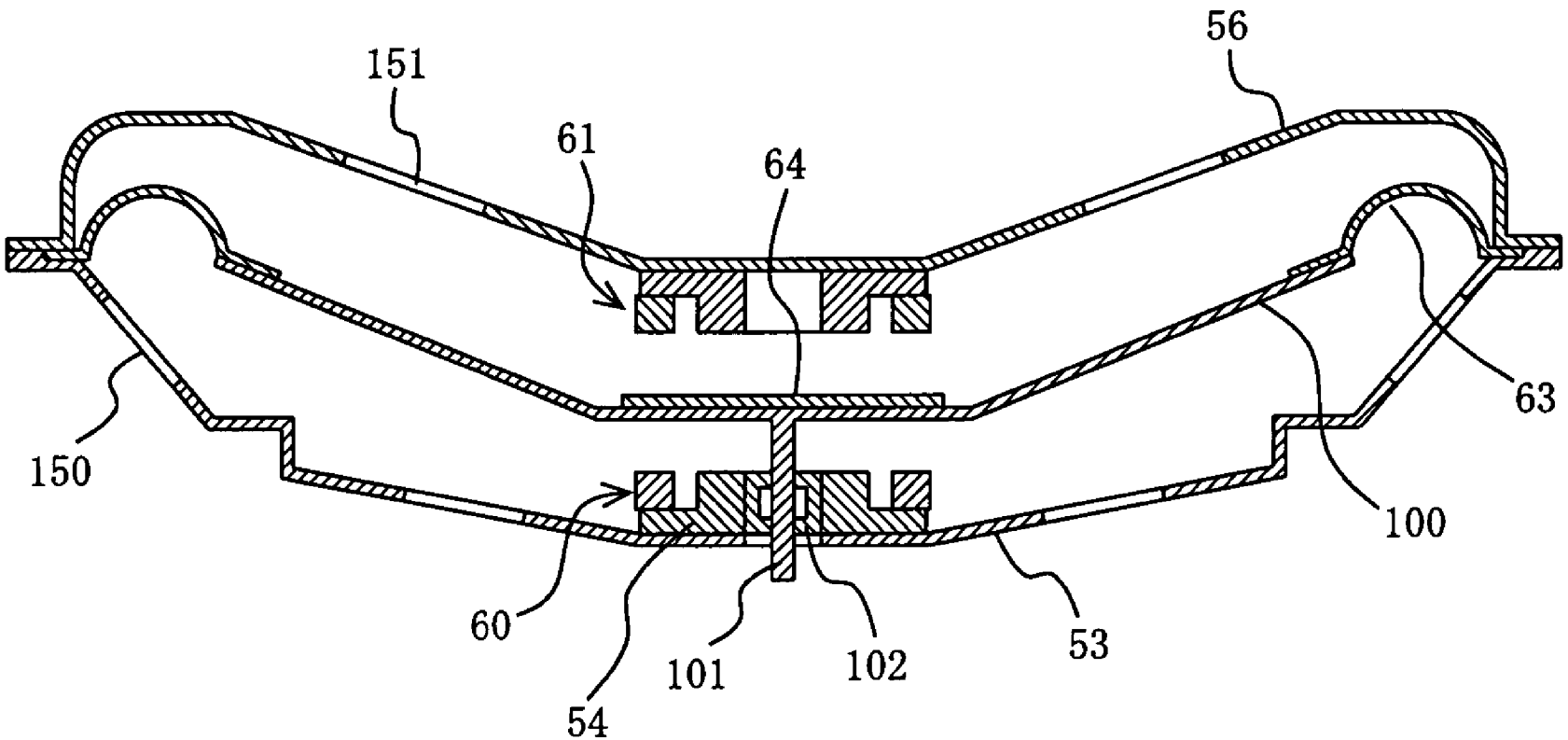
FIG. 7 is a cross-sectional view showing a structure of a fourth variation of the loudspeaker device shown in FIG. 3.

FIG. 7 shows a second example in which a shaft 101 is provided on the center of a diaphragm 100 in the second chamber Wb6 and supported by a bearing 102, which is provided the center of the plate 54 of the first magnetic circuit 60, so that the shaft 101 can slide in the vibration direction of the diaphragm 100. For example, the shaft 101 and the bearing 102 are made of a material of low frictional resistance, such as Teflon resin. In this case, the shaft 101 and the bearing 102 stabilize the vibration direction of the diaphragm 100, and therefore the rolling of the diaphragm does not occur. Accordingly, the magnetic board 64 fixed on the diaphragm 100 translates between the first and second magnetic circuits 60 and 61, generating more stable vibration.

Fourth Embodiment

Figure 8:
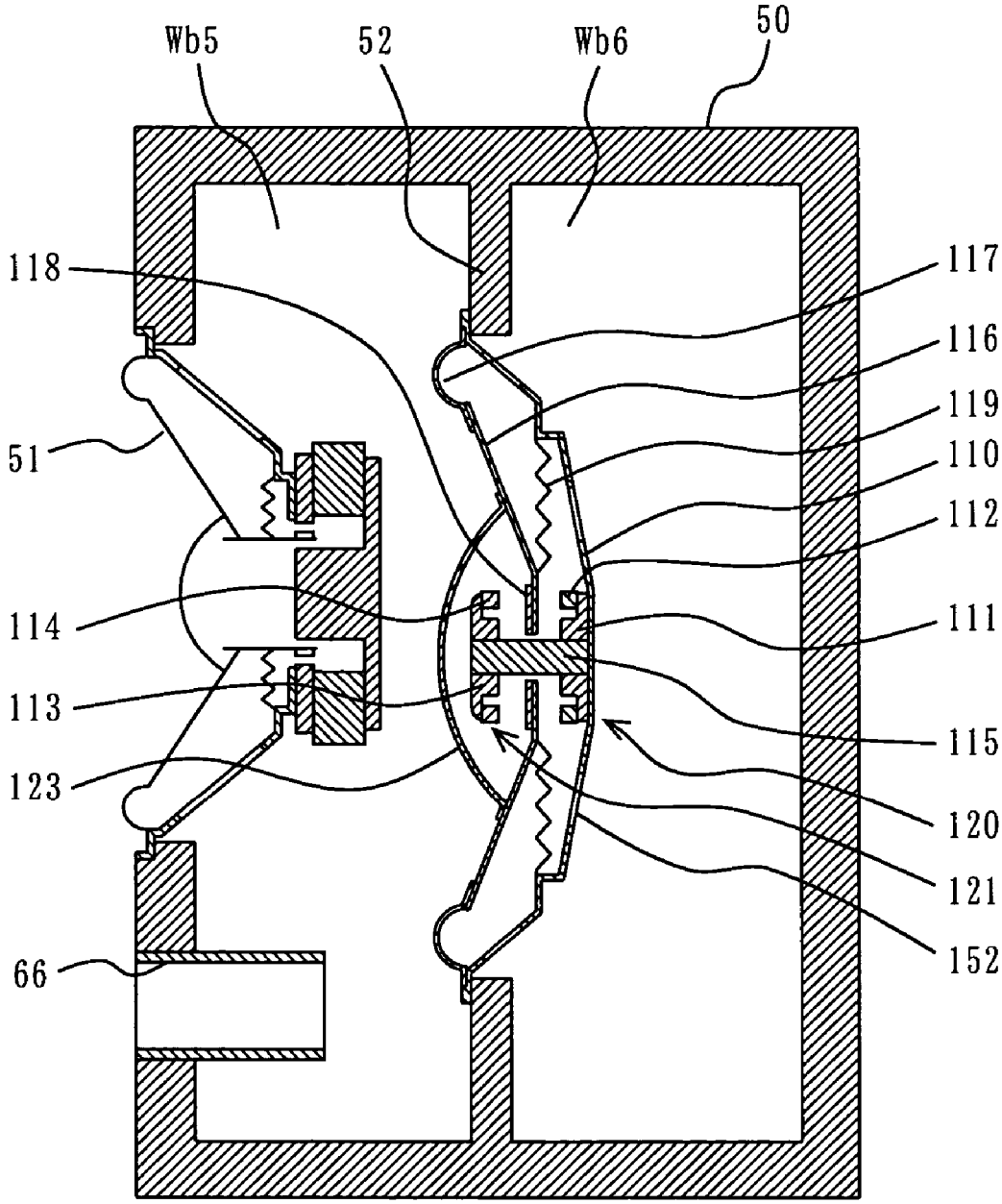
FIG. 8 is a cross-sectional view showing a structure of a loudspeaker device according to a fourth embodiment of the present invention.

A loudspeaker device according to a fourth embodiment of the present invention is described with reference to FIG. 8. FIG. 8 is a cross-sectional view showing a structure of the loudspeaker device according to the fourth embodiment.

In FIG. 8, the loudspeaker device includes the cabinet 50, the speaker unit 51, the parting board 52, the bass-reflex port 66, a frame 110, a coupling rod 115, a diaphragm 116, an edge portion 117, a magnetic board 118, a damper 119, a first magnetic circuit 120, a second magnetic circuit 121, and a dust cap 123. Note that the cabinet 50, the speaker unit 51, the parting board 52, and the bass reflex port 66, which are included in the loudspeaker device according to the fourth embodiment, are as described in the third embodiment, and therefore detailed descriptions thereof are omitted here. In the fourth embodiment, a negative stiffness generation mechanism is substantially formed by the parting board 52, the bass-reflex port 66, the frame 110, the coupling rod 115, the diaphragm 116, the edge portion 117, the magnetic board 118, the damper 119, the first magnetic circuit 120, the second magnetic circuit 121, and the dust cap 123.

The frame 110 is a circular board which has its outer edge fixed in the vicinity of the opening of the parting board 52 and is convex on the side of the second chamber Wb6. The frame 110 has a plurality of sound holes 152 formed therein.

The diaphragm 116 is made of a non-magnetic material, and has a cone-like shape. The diaphragm 116 is situated so as to be convex on the side of the second chamber Wb6. The edge portion 117 is a suspension for supporting an outer edge of the diaphragm 116 in the vicinity of the outer edge of the frame 110. The edge portion 117 is made of an elastomer material, metal foil, or the like, which does not cause air to leak therefrom. The entire outer circumference of the edge portion 117 is connected in the vicinity of the outer edge of the frame 110, and the entire inner circumference of the edge portion 117 supports the outer edge of the diaphragm 116. Accordingly, the parting board 52, the outer edge of the frame 110, the diaphragm 116, and the edge portion 117 form the border between the first and second chambers Wb5 and Wb6, so as to keep the second chamber Wb6 airtight. The diaphragm 116 has a planar portion in its center, and the magnetic board 118, which is a magnetic substance made of iron, permalloy, or the like, is engaged with the planar portion of the diaphragm 116. Note that the diaphragm 116 and the magnetic substance 118 have an opening formed in their centers such that the coupling rod 115 passes through the opening so as to be out of contact therewith and a predetermined gap is formed between the coupling rod 115 and the opening. The damper 119 supports the diaphragm 116 in the vicinity of its center in the second chamber Wb6. The damper 119 is a suspension which is connected in the vicinity of the diaphragm 116 and has its entire outer edge fixed to the frame 110, thereby supporting the diaphragm 116.

The first magnetic circuit 120 includes a plate 111 and a magnet 112. The plate 111 is fixed in the center of the frame 110 so as to face the diaphragm 116. The magnet 112 has a ring-like shape and is fixed on the plate 111. The coupling rod 115 has one end fixed on the center of the plate 111, and is pointed to first chamber Wb5. For example, the coupling rod 115 is a non-magnetic substance formed of a resin material, such as Acrylonitrile-Butadiene-Styrene (ABS) resin, or a metallic material, such as brass or aluminum. The second magnetic circuit 121 includes a plate 113 and a magnet 114. The magnet 114 has a ring-like shape and is fixed on the plate 113. Another end of the coupling rod 115 is fixed on the center of the plate 113. That is, the plates 111 and 113 are fixed on opposite ends of the coupling rod 115, and positions thereof are fixed by the coupling rod 115. The coupling rod 115 is placed so as to pass through openings, which are respectively formed in the center of the diaphragm 116 and in the center of the magnetic board 118, such that the coupling rod 115 is out of contact with the edge of the openings and a predetermined gap is formed between the coupling rod 115 and the edge of each of the openings. The diaphragm 116 is situated between first and second magnetic circuits 120 and 121. The first magnetic circuit 120 (i.e., the plate 111 and the magnet 112) and the second magnetic circuit 121 (i.e., the plate 113 and the magnet 114) are opposed to each other with respect to the magnetic board 118 of the diaphragm 116, so as to form a predetermined gap between the magnetic board 118 and each of the first and second magnetic circuits 120 and 121. The dust cap 123 is a dome-shaped board having its outer edge fixed on the diaphragm 116 in the first chamber Wb5 so as to cover the second magnetic circuit 121. The dust cap 123 prevents air in the second chamber Wb6 from leaking through the gap between the coupling rod 115 and the opening in the center of the diaphragm 116 to the first chamber Wb5.

Described next is an operation of the loudspeaker device according to the fourth embodiment. When an electric signal, such as a music signal, is applied to the speaker unit 51, a drive force is generated in a voice coil to vibrate the cone diaphragm, thereby generating sound. The speaker unit 51 is, for example, a dynamic loudspeaker which operates in a well-known manner, and detailed descriptions thereof are omitted here.

Sound pressure generated by the cone diaphragm of the speaker unit 51 is transmitted into the first chamber Wb5 formed by the front of the cabinet 50, the parting board 52, the diaphragm 116, the edge portion 117, and the back of the speaker unit 51. The sound pressure transmitted into the first chamber Wb5 vibrates the diaphragm 116 supported against the frame 110 by the edge portion of 117.

The magnetic board 118 is connected in the center of the diaphragm 116 which is supported by the damper 119, and is vibrated in the same vibration direction together with the diaphragm 116. The diaphragm 116 is situated between the first and second magnetic circuits 120 and 121 so as to form the predetermined gaps with the first and second magnetic circuits 120 and 121, and therefore the magnetic board 118 is stably vibrated between the first and second magnetic circuits 120 and 121. Specifically, the magnetic board 118 alternately experiences forces of attraction from the first and second magnetic circuits 120 and 121 in the vibration direction of the diaphragm 116 in accordance with the vibration of the diaphragm 116. Note that the magnetic board 118 is in a neutral state at a midpoint between the first and second magnetic circuits 120 and 121 (hereinafter, referred to as an "equilibrium position"). When the magnetic board 118 alternately experiences forces of attraction from the first and second magnetic circuits 120 and 121, a repulsive force is applied to the magnetic board 116 in a such a direction as to amplify vibration of the diaphragm 116, i.e., the magnetic board 118 is repulsed away from the equilibrium position.

The repulsive force described above is exerted in such a direction as to reduce a bouncing force for suppressing the amplitude of the diaphragm 116. Specifically, the repulsive force acts as a negative stiffness for reducing the acoustic stiffness of the second chamber Wb6 which is formed by the rear of the cabinet 50, the parting board 52, the diaphragm 116, the edge portion 117, the dust cap 123, etc. The repulsive force facilitates easy vibration of the diaphragm 116 which is acoustically indirectly vibrated by the sound pressure from the speaker unit 51. This alleviates the bouncing force caused by acoustic stiffness of chambers of the cabinet 50, so that the cone diaphragm of the speaker unit 51 operates as if the cabinet volume of the loudspeaker device is increased.

In the fourth embodiment, the bass-reflex port 66 is provided in the cabinet 50. The bass-reflex port 66 acoustically resonates with an acoustic stiffness caused according to the volume of the cabinet 50, thereby allowing the loudspeaker device according to the fourth embodiment to function as a bass-reflex type loudspeaker device. As described above, the second chamber Wb6 has its volume virtually increased due to a negative stiffness. Specifically, the bass-reflex port 66 acoustically resonates with the acoustic stiffness of a volume larger than the actual volume of the cabinet 50, i.e., volumes of the first and second chambers Wb5 and Wb6. Accordingly, the loudspeaker device according to the fourth embodiment operates in the same manner as a bass-reflex loudspeaker having a large cabinet with the speaker unit 51, and therefore is able to provide lower frequency reproduction.

Further, the loudspeaker device according to the fourth embodiment includes the first and second magnetic circuits 120 and 121 which are opposed to each other with respect to the magnetic board 118 fixed on the cone diaphragm 116 so as to form a predetermined gap between the magnetic board 118 and each of the first and second magnetic circuits 120 and 121. Specifically, the diaphragm 116 having a cone-like shape has a shape effect, which provides the diaphragm 116 with high rigidity as compared with the planar diaphragms described in the first and second embodiments, and therefore the diaphragm 116 can be thinner than the planar diaphragms. That is, the diaphragm 116 can be lighter, thereby further improving bass reproduction efficiency. Moreover, since the first and second magnetic circuits 120 and 121 include the plates 111 and 113 which are magnetic substances, magnetic flux generated in the magnets 112 and 114 can be concentrated. Accordingly, magnetic efficiency is enhanced, making it possible for a smaller magnetic circuit to generate a force of magnetic attraction for generating a required negative stiffness.

Furthermore, in the fourth embodiment, the second magnetic circuit 121 is directly coupled to the first magnetic circuit 120 via the coupling rod 115. Accordingly, in the loudspeaker device according to the fourth embodiment, it is possible to achieve effects similar to those achieved by the loudspeaker devices according to the first through third embodiments, and moreover it is not necessary to use the second frame 56 which is used for fixing the second magnetic circuit 61 in the third embodiment, thereby considerably simplifying the structure of the negative stiffness generation mechanism.

The first and second magnetic circuits 120 and 121 included in the negative stiffness generation mechanism have been described with reference to FIG. 8 as having an outer magnet configuration in which the magnet 112 is placed on an outer portion of the plate 111 and the magnet 114 is placed on an outer portion of the plate 113. However, the first and second magnetic circuits 120 and 121 can have an inner magnet configuration in which magnets are placed in the center of their respective yokes, and a coupling rod is fixed at both ends in the centers of the magnets.

Fifth Embodiment

Figure 9:
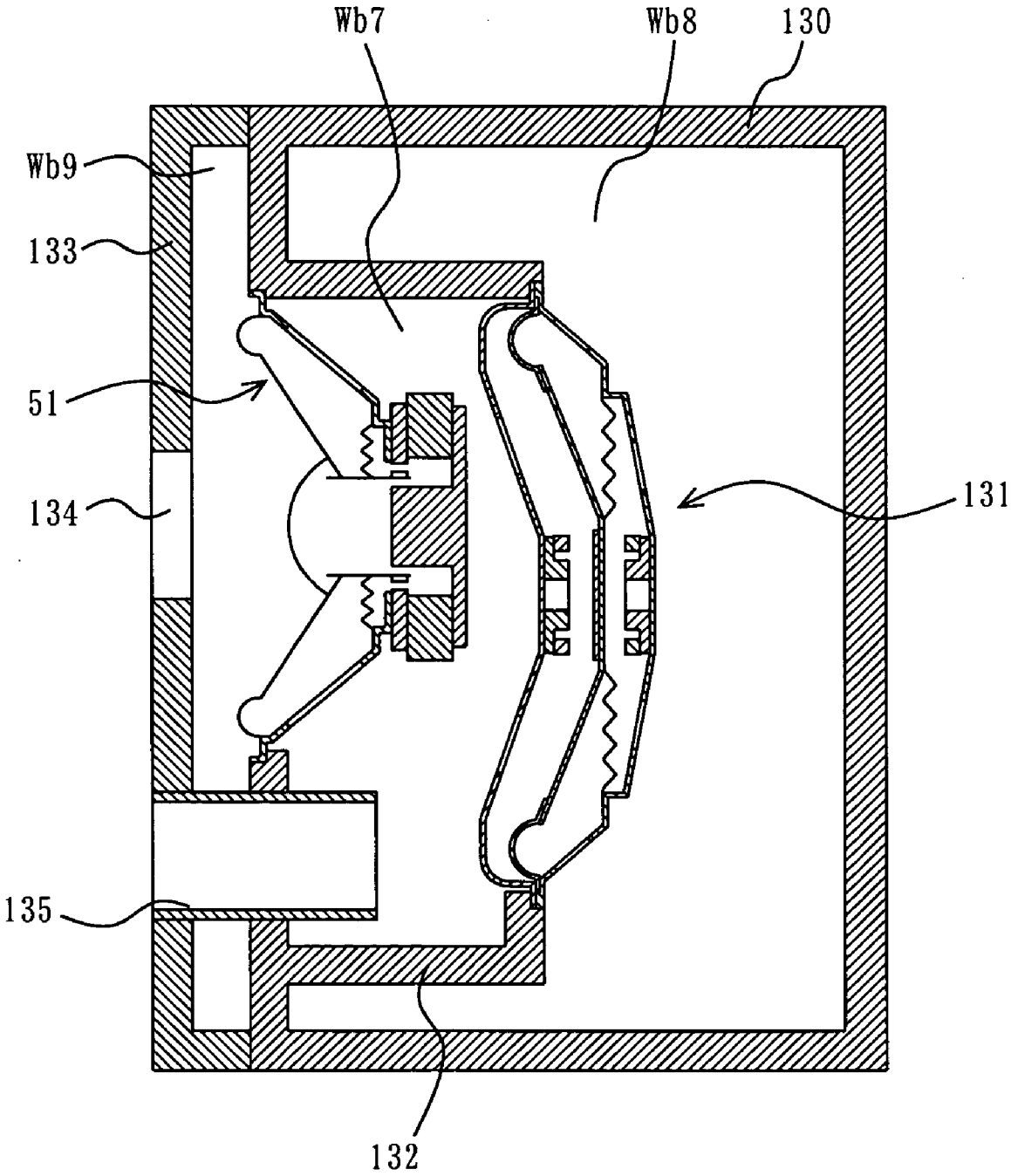
FIG. 9 is a cross-sectional view showing a structure of a loudspeaker device according to a fifth embodiment of the present invention.

A loudspeaker device according to a fifth embodiment of the present invention is described with reference to FIG. 9. FIG. 9 is a cross-sectional view showing a structure of the loudspeaker device according to the fifth embodiment.

In FIG. 9, the loudspeaker device includes a cabinet 130, a speaker unit 51, a negative stiffness generation mechanism 131, a first parting board 132, a second parting board 133, and a bass-reflex port 135. Note that the speaker unit and the negative stiffness generation mechanism, which are included in the loudspeaker device according to the fifth embodiment, are similar to those described in the third embodiment, and therefore detailed descriptions thereof are omitted here.

The speaker unit 51 is attached to an opening of a predetermined size formed in the front of the cabinet 130. The first parting board 132 parts an interior space of the cabinet 130 into first and second chambers Wb7 and Wb8, and has a circular opening formed substantially in its center. The negative stiffness generation mechanism 131 is fixed to the opening of the first parting board 132. Note that the first chamber Wb7 is formed by the front of the cabinet 130, the first parting board 132, the negative stiffness generation mechanism 131, the speaker unit 51, etc., and the second chamber Wb8 is formed by the rear of the cabinet 130, the first parting board 132, the negative stiffness generation mechanism 131, etc.

The second parting board 133 is situated in front of the cabinet 130 (i.e., in front of the speaker unit 51). The second parting board 133 is fixed in front of the cabinet 130 so as to form a third chamber Wb9 in front of the speaker unit 51. Note that the third chamber Wb9 is formed by the front of the cabinet 130, the parting board 133, the front of the speaker unit 51, etc. The second parting board 133 has a sound hole 134 in the vicinity of an area facing the speaker unit 51. The third chamber Wb9 is exposed to the exterior space through the sound hole 134.

The bass-reflex port 135 is a hollowed acoustic tube attached to the cabinet 130. The bass-reflex port 135 is provided in such a position as to allow the first chamber Wb7 and the exterior space to be in communication with each other. For example, the bass-reflex port 135 is provided so as to extend from the front of the cabinet 130 through the third cabinet Wb9 to the front of the second parting board 133.

Described next is an operation of the loudspeaker device according to the fifth embodiment. When an electric signal, such as a music signal, is applied to the speaker unit 51, a drive force is generated in a voice coil to vibrate the cone diaphragm, thereby generating sound. As described in the third embodiment, the negative stiffness generation mechanism provides a negative stiffness for reducing the acoustic stiffness of the second chamber Wb8. This alleviates bouncing force caused by acoustic stiffness of chambers of the cabinet 130, so that the cone diaphragm of the speaker unit 51 operates as if the cabinet volume of the loudspeaker device is increased.

As described in the third embodiment, the bass-reflex port 135 provided in the first chamber Wb7 acoustically resonates the acoustic stiffness of a volume larger than the actual volume of the cabinet 130, i.e., volumes of the first and second chambers Wb7 and Wb8. Accordingly, the loudspeaker device according to the fifth embodiment operates in the same manner as a bass-reflex loudspeaker having a large cabinet with the speaker unit 51, and therefore is able to provide lower frequency reproduction.

Further, the loudspeaker device according to the fifth embodiment additionally includes the third chamber Wb9 formed by the second parting board 133, etc., in the front of the speaker unit 51, and also includes the sound hole 134. The third chamber Wb9 and the sound hole 134 collaboratively serve as a high-cut filter for acoustically cutting off a high frequency range of the speaker unit 51. In a bass reproduction loudspeaker device, an electric filter is generally used to cut off an unwanted high frequency range. However, the loudspeaker device according to the fifth embodiment does not require such an electric filter.

As described above, in the loudspeaker device according to the fifth embodiment, it is possible to achieve effects similar to those achieved by the loudspeaker devices according to the first through fourth embodiments, and moreover it is possible to use an acoustic filter as a high-cut filter, thereby simplifying the system structure. Further, frequencies to be cut off are determined by the size of the sound hole 134, and therefore high frequency adjustments can be readily made.

Sixth Embodiment

Figure 10:
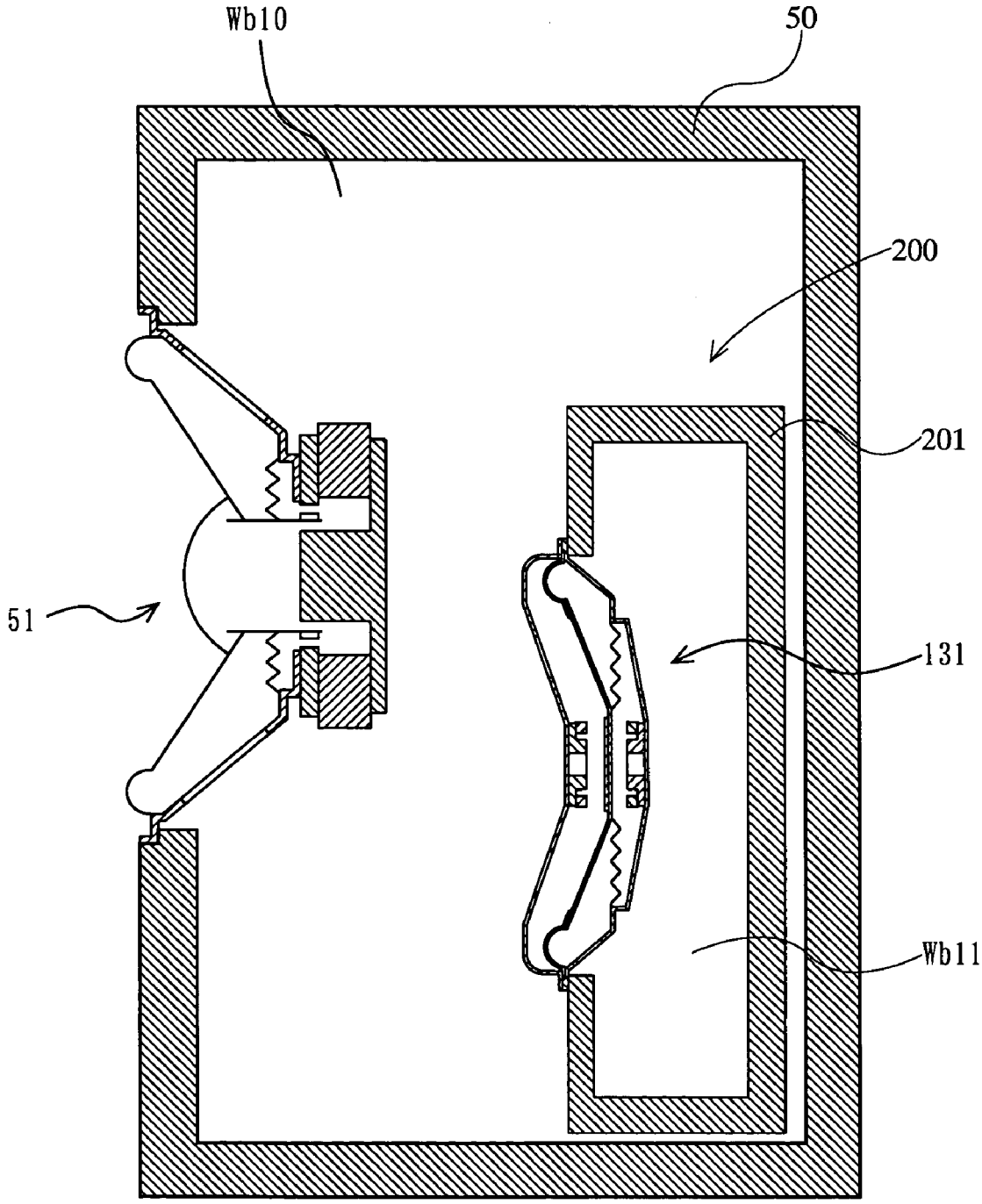
FIG. 10 is a cross-sectional view showing a structure of a loudspeaker device according to a sixth embodiment of the present invention.
Figure 11:
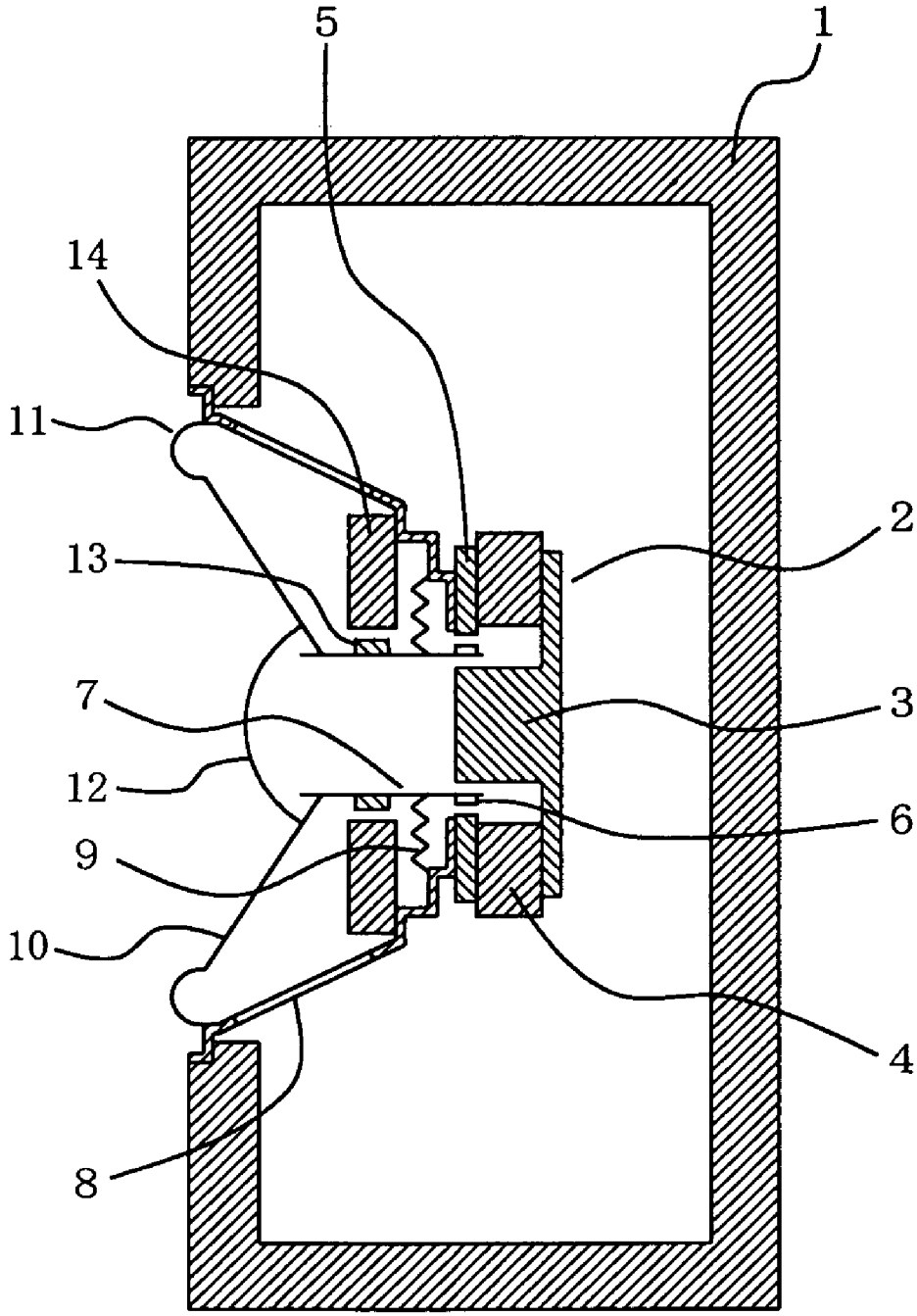
FIG. 11 PRIOR ART
FIG. 11 is a cross-sectional view showing a structure of a conventional loudspeaker device.

A loudspeaker device according to a sixth embodiment of the present invention is described with reference to FIG. 10. The sixth embodiment is directed to a bass booster which is provided in a typical conventional compact loudspeaker device to realize satisfactory bass reproduction with a small cabinet of the loudspeaker device. Specifically, the bass booster of the present invention provided in the conventional loudspeaker device boosts bass reproduction capabilities of the loudspeaker device. FIG. 10 is a cross-sectional view showing a structure of the loudspeaker device including the bass booster.

In FIG. 10, the loudspeaker device includes the cabinet 50, the speaker unit 51, and a bass booster 200 provided in the cabinet 50. The bass booster 200 includes a cabinet 201 and the negative stiffness generation mechanism 131. Note that the negative stiffness generation mechanism 131 is as described in the third and fifth embodiments, and therefore detailed descriptions thereof are omitted here.

The speaker unit 51 is attached to an opening of a predetermined size formed in the front of the cabinet 50. A first chamber Wb10 is formed by inner walls and the back of the speaker unit 51. The device shown in FIG. 10, which includes the first chamber Wb10, the cabinet 50, and the speaker unit 51, is an exemplary conventional loudspeaker device. The bass booster 200 can be used with any loudspeaker device so long as the loudspeaker device has a chamber.

The bass booster 200 is situated in the first chamber Wb10. The cabinet 201 has a circular opening formed therein. The negative stiffness generation mechanism 131 is fixed to the opening of the cabinet 201. A second chamber Wb11 is formed by internal walls of the cabinet 201 and the negative stiffness generation mechanism 131. Note that it is not necessary to fix the bass booster 200 to the loudspeaker device, and the bass booster 200 can be located anywhere in the first chamber Wb10 so long as a diaphragm of the negative stiffness generation mechanism 131 is exposed to the first chamber Wb10.

Described next is an operation of the loudspeaker device according to the sixth embodiment. When an electric signal, such as a music signal, is applied to the speaker unit 51, a drive force is generated in a voice coil to vibrate the cone diaphragm, thereby generating sound. The speaker unit 51 is, for example, a dynamic loudspeaker which operates in a well-known manner, and detailed descriptions thereof are omitted here.

Sound pressure generated by the cone diaphragm of the speaker unit 51 is transmitted into the first chamber Wb10 formed by the cabinet 50, the back of the speaker unit 51, etc.

The sound pressure transmitted into the first chamber Wb10 vibrates the diaphragm of the negative stiffness generation mechanism 131. As described in the third embodiment, the negative stiffness generation mechanism 131 provides a negative stiffness for reducing the acoustic stiffness of the second chamber Wb11. This alleviates bouncing force caused by acoustic stiffness of chambers of the cabinet 50, so that the cone diaphragm of the speaker unit 51 operates as if the cabinet volume of the loudspeaker device is increased.

As described above, in the sixth embodiment, the bass booster is provided in a conventional loudspeaker device, making it possible to readily extend the bass reproduction limit of the loudspeaker device. That is, by merely providing the bass booster of the present invention in the user's loudspeaker device, it is possible to boost bass reproduction capabilities of the user's speaker system.

Although the foregoing is directed to a case where the bass booster of the present invention is provided in a closed enclosure type loudspeaker device, a similar effect can also be achieved by providing the bass booster in a bass-reflex type or drone-cone type loudspeaker device. Moreover, although the bass booster has been described as including the negative stiffness generation mechanism 131, a different negative stiffness generation mechanism can be included in the bass booster in order to achieve an effect similar to that achieved in the case of the negative stiffness generation mechanism 131. It goes without saying that the similar effect can be achieved by providing to the bass booster a variation of the negative stiffness generation mechanism described in the third embodiment or a negative stiffness generation mechanism described in the first, second or fourth embodiment.

While the invention has been described in detail, the foregoing description is in all aspects illustrative and not restrictive. It is understood that numerous other modifications and variations can be devised without departing from the scope of the invention.

What is claimed is:

1. A loudspeaker device comprising:

a cabinet;

a parting board for parting an interior space of the cabinet into a first chamber and a second chamber;

a speaker unit provided in the first chamber of the cabinet such that a front face of the speaker unit faces an exterior space exterior to the cabinet, the speaker unit being operable to vibrate in accordance with an input electrical signal; and a negative stiffness generation mechanism provided to the parting board, the negative stiffness generation mechanism being operable to reduce an acoustic stiffness of the second chamber, wherein the acoustic stiffness suppresses vibration of the speaker unit, the negative stiffness generation mechanism including:

a diaphragm provided at a border between the first chamber and the second chamber, the diaphragm being operable to vibrate due to a drive force generated by the vibration of the speaker unit propagated through the first chamber;

at least one suspension for supporting the diaphragm against the parting board; and a repulsive force generation section for, when the diaphragm vibrates and moves away from an equilibrium position in a vibration direction of the diaphragm toward the first chamber, applying a repulsive force to a front face and a back face of the diaphragm in a direction in which the diaphragm moves away from the equilibrium position toward the first chamber, the repulsive force being different from the drive force, and for, when the diaphragm vibrates and moves away from an equilibrium position in a vibration direction of the diaphragm toward the second chamber, applying a repulsive force to the front face and the back face of the diaphragm in a direction in which the diaphragm moves away from the equilibrium position toward the second chamber, the repulsive force being different from the drive force.

2. The loudspeaker device according to claim 1, wherein the repulsive force generation section includes:

a magnetic substance fixed on at least a portion of the diaphragm; and a plurality of fixed magnets fixed opposite to each other with respect to the magnetic substance so as to form a predetermined gap in front of and behind the magnetic substance in the vibration direction of the diaphragm.

3. The loudspeaker device according to claim 2, wherein the diaphragm and the magnetic substance are integrally formed.

4. The loudspeaker device according to claim 1, wherein the repulsive force generation section includes:

a magnetic substance fixed on at least a portion of the diaphragm;

a plurality of plates fixed opposite to each other with respect to the magnetic substance so as to form a predetermined gap in front of and behind the magnetic substance in the vibration direction of the diaphragm, the plurality of plates each having a center and a center pole formed in the center; and a plurality of magnets each fixed to a corresponding one of the plurality of plates and ring-shaped around the plate.

5. The loudspeaker device according to claim 1, wherein the repulsive force generation section includes:

a magnetic substance fixed on at least a portion of the diaphragm;

a plurality of yokes fixed opposite to each other with respect to the magnetic substance so as to form a predetermined gap in front of and behind the magnetic substance in the vibration direction of the diaphragm; and a plurality of magnets each fixed in a center of a corresponding one of the plurality of yokes.

6. The loudspeaker device according to claim 1, wherein the repulsive force generation section includes:

a magnet fixed on at least a portion of the diaphragm; and a plurality of magnetic substances fixed opposite to each other with respect to the magnet so as to form a predetermined gap in front of and behind the magnet in the vibration direction of the diaphragm.

7. The loudspeaker device according to claim 1, wherein the repulsive force generation section includes:

a diaphragm-side magnet fixed on at least a portion of the diaphragm; and a ring-shaped fixed magnet fixed outside an outer edge of the diaphragm-side magnet so as to form a predetermined gap between the ring-shaped fixed magnet and the diaphragm-side magnet.

8. The loudspeaker device according to claim 7, wherein the diaphragm-side magnet and the ring-shaped fixed magnet are magnetized so as to have a same magnetization direction in the equilibrium position.

9. The loudspeaker device according to claim 7, wherein the repulsive force generation section further includes ring-shaped magnetic plates fixed on opposite pole faces of the ring-shaped fixed magnet.

10. The loudspeaker device according to claim 1, wherein the diaphragm has a cone shape.

11. The loudspeaker device according to claim 1, wherein the at least one suspension is an edge portion formed of an airtight material, the suspension having an outer edge entirely connected to the parting board and an inner edge entirely supporting an outer edge of the diaphragm, and wherein the second chamber is kept airtight by the cabinet, the parting board, the edge portion, and the diaphragm.

12. The loudspeaker device according to claim 11, wherein the suspension further includes:

a shaft provided in a center of the diaphragm along the vibration direction of the diaphragm; and a bearing fixed so as to allow the shaft to slide in the vibration direction of the diaphragm.

13. The loudspeaker device according to claim 11, wherein the suspension further includes a plurality of elastic bodies fixed in front of and behind the diaphragm in the vibration direction thereof, so as to have one end connected to the diaphragm, the plurality of elastic bodies expanding and contracting in the vibration direction.

14. The loudspeaker device according to claim 11, wherein the suspension further includes at least one damper having an inner edge connected to the diaphragm and a fixed outer edge.

15. The loudspeaker device according to claim 1, further comprising an acoustic resonance section provided in the first chamber of the cabinet so as to resonate with an acoustic stiffness of the first chamber, thereby boosting bass.

16. The loudspeaker device according to claim 15, further comprising a board-like member fixed to the cabinet so as to form a third chamber in front of the speaker unit, the board-like member having an opening of a predetermined size such that the board-like member functions as a high-cut filter for acoustically cutting off a high frequency range of the speaker unit.

17. The loudspeaker device according to claim 15, wherein the first chamber has a volume smaller than that of the second chamber.

18. The loudspeaker device according to claim 15, wherein the acoustic resonance section functions as a bass-reflex port which is formed by a hollowed tube and allows the first chamber and an exterior space to be in communication with each other.

19. The loudspeaker device according to claim 15, wherein the acoustic resonance section is a passive radiator having a rim supported by an edge portion attached to the cabinet.

20. The loudspeaker device according to claim 1, wherein the diaphragm has an opening of a predetermined size formed in a center thereof, wherein the repulsive force generation section includes:

a magnetic substance having an opening of a same size as that of the opening of the diaphragm, the magnetic substance being fixed on the diaphragm such that the opening thereof is aligned with the opening of the diaphragm;

a first magnetic circuit fixed opposite to the magnetic substance so as to form a predetermined gap on a second chamber side in the vibration direction of the diaphragm;

a coupling rod having one end fixed in a center of the first magnetic circuit and passing through the openings of the diaphragm and the magnetic substance so as to form a gap with edges of the openings of the diaphragm and the magnetic substance; and a second magnetic circuit fixed opposite to the magnetic substance and having its center fixed to another end of the coupling rod, the second magnetic circuit forming a predetermined gap with the magnetic substance on a first chamber side in the vibration direction of the diaphragm, wherein the negative stiffness generation mechanism includes a dust cap having an outer edge connected to the diaphragm so as to cover at least the first magnetic circuit and the opening of the diaphragm from the first chamber.

* * * * *